US010879616B2

(12) United States Patent
Cheng et al.

(10) Patent No.: US 10,879,616 B2
(45) Date of Patent: Dec. 29, 2020

(54) SHARED-APERTURE ANTENNA

(71) Applicant: University of Electronic Science and Technology of China, Chengdu (CN)

(72) Inventors: Yujian Cheng, Chengdu (CN); Yanran Ding, Chengdu (CN); Jinfan Zhang, Chengdu (CN); Chunxu Bai, Chengdu (CN); Yong Fan, Chengdu (CN); Kaijun Song, Chengdu (CN); Xianqi Lin, Chengdu (CN); Bo Zhang, Chengdu (CN)

(73) Assignee: UNIVERSITY OF ELECTRONIC SCIENCE AND TECHNOLOGY OF CHINA, Chengdu (CN)

( * ) Notice: Subject to any disclaimer, the term of this patent is extended or adjusted under 35 U.S.C. 154(b) by 0 days.

(21) Appl. No.: 16/556,258

(22) Filed: Aug. 30, 2019

(65) Prior Publication Data

US 2020/0076086 A1 Mar. 5, 2020

(30) Foreign Application Priority Data

Aug. 30, 2018 (CN) ..... 2018 1 1002125
May 10, 2019 (CN) ..... 2019 1 0387203
(Continued)

(51) Int. Cl.
*H01P 3/12* (2006.01)
*H01Q 13/10* (2006.01)
(Continued)

(52) U.S. Cl.
CPC ..... *H01Q 13/10* (2013.01); *H01P 3/121* (2013.01); *H01Q 1/48* (2013.01); *H01Q 9/0407* (2013.01);
(Continued)

(58) Field of Classification Search
CPC ..... H01Q 13/10; H01Q 1/48; H01Q 9/0407; H01Q 9/30; H01Q 9/40; H01Q 9/44;
(Continued)

(56) References Cited

U.S. PATENT DOCUMENTS 7,808,439 B2 * 10/2010 Yang ..... H01Q 13/22 343/771
10,299,368 B2 * 5/2019 Huang ..... H01P 3/121

* cited by examiner

*Primary Examiner* — Jimmy T Vu
(74) *Attorney, Agent, or Firm* — Matthias Scholl P.C.; Matthias Scholl

(57) ABSTRACT

A shared-aperture antenna includes a first copper metal layer; a second copper metal layer; and a dielectric substrate layer sandwiched between the first copper metal layer and the second copper metal layer. The dielectric substrate layer includes a plurality of metallized vias. The first copper metal layer is in communication with the second copper metal layer via the plurality of metallized vias. The plurality of metallized vias includes first metallized vias forming an inner circular ring and second metallized vias forming an outer circular ring with respect to the center of the antenna. The first copper metal layer, the dielectric substrate layer, the second copper metal layer, and the first metallized vias form a substrate integrated waveguide (SIW) circular cavity slot antenna. The first copper metal layer, the dielectric substrate layer, the second copper metal layer, the first metallized vias and the second metallized vias form a coaxial cavity slot antenna.

10 Claims, 28 Drawing Sheets

(30) Foreign Application Priority Data

May 10, 2019 (CN) ..... 2019 1 0387210
May 10, 2019 (CN) ..... 2019 1 0387242
May 10, 2019 (CN) ..... 2019 1 0387275
May 10, 2019 (CN) ..... 2019 1 0388307

(51) Int. Cl.
*H01Q 21/06* (2006.01)
*H01Q 1/48* (2006.01)
*H01Q 9/04* (2006.01)
*H01Q 21/00* (2006.01)

(52) U.S. Cl.
CPC ..... *H01Q 21/0075* (2013.01); *H01Q 21/064* (2013.01)

(58) Field of Classification Search
CPC ..... H01Q 21/005; H01Q 21/0075; H01Q 21/064; H01P 3/12; H01P 3/121; H01P 3/18; H01P 5/103; H01P 5/107
See application file for complete search history.

SHARED-APERTURE ANTENNA

CROSS-REFERENCE TO RELATED APPLICATIONS

Pursuant to 35 U.S.C. § 119 and the Paris Convention Treaty, this application claims foreign priority to Chinese Patent Application No. 201811002125.2 filed Aug. 30, 2018, to Chinese Patent Application No. 201910387203.3 filed May 10, 2019, to Chinese Patent Application No. 201910387210.3 filed May 10, 2019, to Chinese Patent Application No. 201910387242.3 filed May 10, 2019, to Chinese Patent Application No 201910387275.8 filed May 10, 2019, and to Chinese Patent Application No. 201910388307.6 filed May 10, 2019. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

This disclosure relates to shared-aperture antennas.

Shared aperture antennas combine the functionality of several antennas with multiple bands and polarities into one aperture.

Conventional shared-aperture antennas can make full use of the radiation aperture and reduce the mutual interference by using proper topology of antenna and the feed network, so that multiple antennas with different realization functions can work independently. They can be used in radar detection, measurement and other fields.

Conventional shared-aperture antennas adopt the staggered arrangement of antenna with different frequencies, which leads to the separated placement, large occupied area, and low utilization efficiency of the antenna aperture. Moreover, the mutual coupling effect between antennas leads to poor isolation between antennas with different frequencies.

SUMMARY

The disclosure provides a plurality of shared-aperture antennas.

A shared-aperture antenna comprises a first copper metal layer; a second copper metal layer; and a dielectric substrate layer being sandwiched between the first copper metal layer and the second copper metal layer. The dielectric substrate layer comprises a plurality of metallized vias. The first copper metal layer is in communication with the second copper metal layer via the plurality of metallized vias which run through the dielectric substrate layer. The plurality of metallized vias comprises first metallized vias forming an inner circular ring and second metallized vias forming an outer circular ring with respect to a center of the antenna; the first copper metal layer, the dielectric substrate layer, the second copper metal layer, and the first metallized vias form a substrate integrated waveguide (SIW) circular cavity slot antenna; the first copper metal layer, the dielectric substrate layer, the second copper metal layer, the first metallized vias and the second metallized vias form a coaxial cavity slot antenna; and the SIW circular cavity slot antenna and the coaxial cavity slot antenna comprises a plurality of radiating slots disposed in the second copper metal layer.

The operating frequency ratios of the SIW circular cavity slot antenna and the coaxial cavity slot antenna can be calculated as follows:

$$\frac{f_1}{f_2} = \frac{R_1}{R_2} = r$$

where $f_1$ is an operating frequency of the SIW circular cavity slot antenna, $f_2$ is an operating frequency of the SIW coaxial cavity slot antenna, $R_1$ is a radius of the outer circular ring, $R_2$ is a radius of the inner circular ring, and $r \leq 8$.

A shared-aperture antenna comprises a first copper metal layer, a second copper metal layer; and a dielectric substrate layer being sandwiched between the first copper metal layer and the second copper metal layer. The dielectric substrate layer comprises four circular slots with the same size located in four corners of the substrate layer, respectively; the four circular slots run through the second copper metal layer, the dielectric substrate layer and the first copper metal layer; each circular slot comprises a metallized inner wall functioning as a circular waveguide antenna; a plurality of assistant metallized vias are disposed between two adjacent circular waveguide antennas; the plurality of assistant metallized vias run through the first copper metal layer, the dielectric substrate layer and the second copper metal layer; the second copper metal layer comprises a center and a radiating slot is disposed in the center; and the first copper metal layer, the dielectric substrate layer, the second copper metal layer and the radiating slot form a cavity slot antenna; the cavity slot antenna comprises four side walls, and the circular waveguide antenna and the plurality of assistant metallized vias are disposed on the four side walls.

A shared-aperture antenna comprises a first copper metal layer; a second copper metal layer; and a dielectric substrate layer being sandwiched between the first copper metal layer and the second copper metal layer.

The second copper metal layer comprises a rectangular monopole, a spiral line, and a plurality of rectangular stubs; the rectangular monopole comprises a first side and a second side; the plurality of rectangular stubs is connected to the first side of the rectangular monopole; the plurality of rectangular stubs and the rectangular monopole form a comb structure; the spiral line is connected to the second side of the rectangular monopole, and is disposed on one end of the rectangular monopole; the rectangular monopole, the spiral line and the plurality of rectangular stubs form a printed inverted-F antenna (PIFA); the dielectric substrate layer comprises a plurality of metallized vias, and the comb structure communicates with the first copper metal layer through the plurality of metallized vias to form a SIW leaky-wave antenna; and the SIW leaky-wave antenna comprises a radiating side disposed on the first side of the rectangular monopole connected to the plurality of rectangular stubs.

The SIW leaky-wave antenna comprises a waveguide feeding structure; the waveguide feeding structure comprises a waveguide and a waveguide to SIW transition structure; the waveguide to SIW transition structure comprises the plurality of metallized vias running through the dielectric substrate layer and a rectangular slot disposed in the first copper metal layer; and the waveguide is disposed under the first copper metal layer.

The printed inverted-F antenna (PIFA) comprises a microstrip feeding structure disposed on the dielectric substrate layer; the microstrip feeding structure comprises a sub-miniature-A (SMA) connector and a microstrip line connected to the SMA connector; and the microstrip line is connected to the rectangular monopole to feed the antenna.

A shared-aperture antenna comprises a first copper metal layer; a first dielectric substrate layer comprising a plurality of first metallized vias; a feeding network layer; a second dielectric substrate layer; a middle copper metal layer; a third dielectric substrate layer comprising a plurality of second metallized vias; and a second copper metal layer. The second copper metal layer is electrically connected to the middle copper metal layer by the plurality of second metallized vias running through the third dielectric substrate layer; the middle copper metal layer, the third dielectric substrate layer, the second copper metal layer and the plurality of second metallized vias form a plurality of SIW cavities which are arranged in a matrix; in each SIW cavity, the second copper metal layer comprises a radiating slot, and the middle copper metal layer comprises a feeding slot, to form a SIW waveguide cavity slot antenna; and the feeding network layer feeds a signal to the SIW waveguide cavity slot antenna through the feeding slot; the middle copper metal layer is electrically connected to the first copper metal layer by the plurality of first metallized vias running through the first dielectric substrate layer, the feeding network layer and the second dielectric substrate layer; the plurality of first metallized vias is disposed along one side of the first dielectric substrate layer; the plurality of first metallized vias is electrically insulated from the feeding network layer; the first cooper metal layer, the first dielectric layer, the feeding network layer, the second dielectric substrate layer, the middle copper metal layer, the third dielectric substrate layer and the second copper metal layer form a patch antenna; the patch antenna comprises one equivalent magnetic flux radiation edge which is parallel to an equivalent magnetic flux radiation edge and is short-circuited connected to a metal ground; and a short circuit point is under the first copper metal layer.

The center frequencies of the SIW waveguide cavity slot antenna and the patch antenna are random two frequencies, which meets $fL0/fH0 \geq 2$, fl0 is a center frequency of the SIW waveguide cavity slot antenna, and fH0 is a center frequency of the patch antenna.

The patch antenna is the square or the circular patch.

The feeding way of the patch antenna is the coaxial feeding or the slot feeding.

The patch antenna comprises one or more short-circuited end.

The SIW waveguide cavity slot antenna is the square or the circular SIW waveguide cavity slot antenna. The operating mode is random like the dominant mode and the higher order mode.

The feeding network layer uses a strip line, a microstrip line, a coplanar waveguide or a coplanar strip line.

The polarizations of the SIW waveguide cavity slot antenna and the patch antenna are both linear polarizations.

A shared-aperture antenna comprises a radiating structure, a waveguide feeding structure and a microstrip feeding structure. The radiating structure comprises a first dielectric substrate layer, a metal ground, a second dielectric substrate layer, a first copper metal layer, a third dielectric substrate layer, and a second copper metal layer, successively; the second copper metal layer comprises a SIW slot array; the third dielectric substrate layer comprises a plurality of first metallized vias, and the second copper metal layer communicates with the first copper metal layer by the plurality of metallized via running through the third dielectric substrate layer to form a radiating antenna; the microstrip feeding structure is disposed under the first dielectric substrate layer; the radiating antenna is excited by a coupled slot disposed in the metal ground; and the waveguide feeding structure comprises a waveguide and a waveguide to SIW transition structure; the waveguide to SIW transition structure comprises a plurality of second metallized vias running through the second dielectric substrate layer and the first dielectric substrate layer; the first copper metal layer is connected to the metal ground by the second metallized vias; the first copper metal layer and the metal ground comprise windows; and the waveguide is disposed under the first dielectric substrate layer.

Advantages of the shared-aperture antennas according to embodiments of the disclosure are summarized as follows: The shared-aperture antennas use the structure-reused technology to realize the design of dual-band or tri-band shared-aperture antennas. Compared with the traditional interlaced and overlapping layout, shared-aperture antennas in this invention reduce the occupied aperture area and enhance the aperture utilization ratio efficiently. In addition, the operation frequencies of these antennas are not only limited to the even ration, but also can be expanded to odd ratio and decimal ratio. At the same time, SIW structure is used. By using the high-pass characteristic, the channel isolation between higher and lower frequency antennas can be improved.

BRIEF DESCRIPTION OF DRAWINGS

FIGS. 6A-6B show a section view of SIW feed structure and ribbon line feed structure of the dual-band shared-aperture antenna array with structure-reused technology in Example 2, among which, FIG. 6A shows the SIW feed structure, FIG. 6B shows the ribbon line feed structure.

FIGS. 18A-18E show the configuration of the high-frequency part of miniaturized high isolation shared-aperture antenna with structure-reused technology in Example 5, among which, FIG. 18A shows the side view, FIG. 18B shows the top copper metal layer, FIG. 18C shows the middle copper metal layer, FIG. 18D shows the layer of feed network, FIG. 18E shows the bottom copper metal layer.

FIGS. 20A-20B shows the S-parameter and radiation pattern of the sub-6G antenna in Example 5, among which, FIG. 20A shows the S-parameter, FIG. 20B shows the radiation pattern.

FIGS. 21A-21B show the S-parameter and radiation pattern of sub-6G antenna in Example 5, among which, FIG. 21A shows the S-parameter, FIG. 21B shows the radiation pattern.

DETAILED DESCRIPTION

To further illustrate, embodiments detailing a shared-aperture antenna are described below. It should be noted that the following embodiments are intended to describe and not to limit the disclosure.

Example 1

Figure 2:
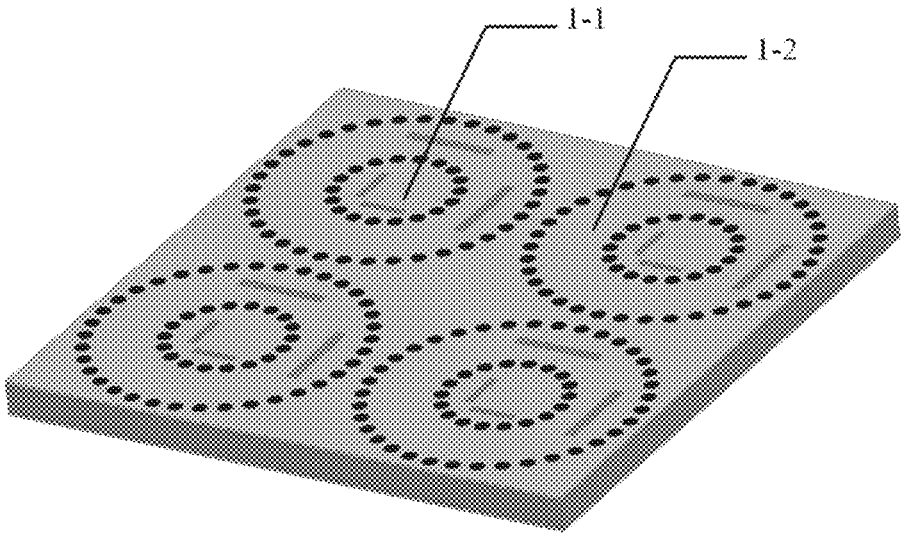
FIG. 2 shows the configuration of the 2×2 dual-band shared-aperture antenna with structure-reused technology in Example 1.
Figure 3:
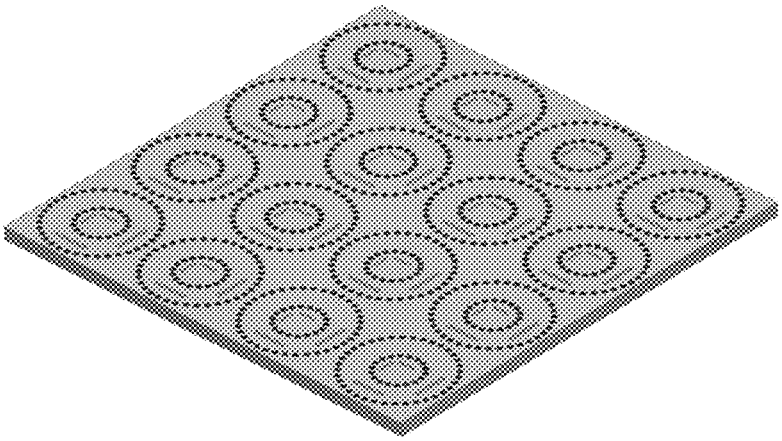
FIG. 3 shows the configuration of the 4×4 dual-band shared-aperture antenna with structure-reused technology in Example 1.

A dual-band cavity backed shared-aperture antenna array with structure-reused technology is presented whose 2×2 radiation structure is shown in FIG. 2. And every antenna element comprises: a substrate integrated waveguide (SIW) circular cavity slot antenna 1-1 and coaxial cavity slot antenna 1-2. In this embodiment, the frequency ratio of the antennas is less than 8, and the high and low frequency antennas are fused by the structural particularity, without adding additional aperture, and high isolation with the high aperture reuse efficiency is achieved.

Figure 1A:
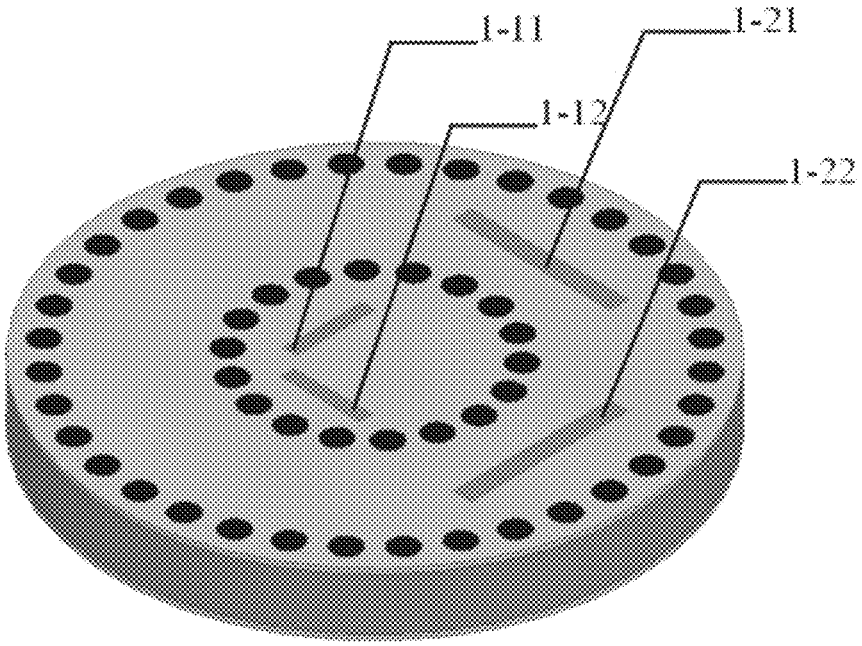
FIGS. 1A-1B show the configuration of the dual-band shared-aperture antenna with structure-reused technology in Example 1.
Figure 1B:
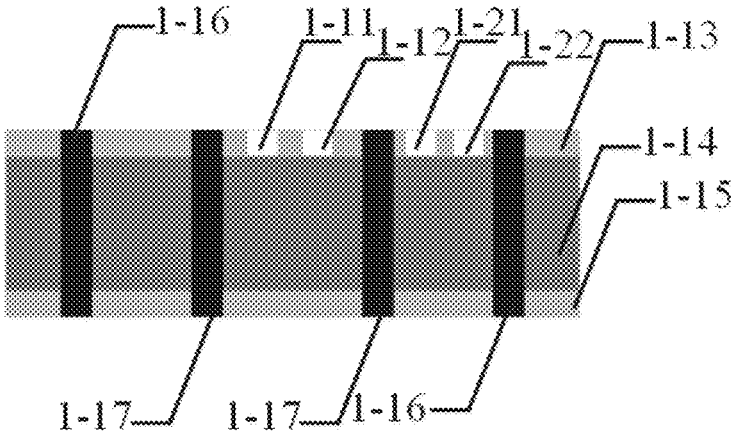

In this embodiment, FIGS. 1A-1B show the configuration of the antenna element, which comprises the first copper metal layer 1-15, the dielectric substrate layer 1-14 and the second copper metal layer 1-13 successively from top to bottom; the second copper metal layer 1-13 and the first copper metal layer 1-15 can be connected by the metallized vias which run through the dielectric substrate layer 1-14, and these metallized vias comprise the metallized vias 1-17 located in inner circular rings and the metallized vias 1-16 which is located in outer circular rings can be arranged in circular rings. The metallized vias 1-17 close the cavity backed antenna.

The substrate integrated waveguide (SIW) circular cavity slot antenna 1-1 can be made up of the first copper metal layer 1-15, the dielectric substrate layer 1-14, the second copper metal layer 1-13 and the metallized vias 1-17 which are located in inner circular rings. The SIW circular cavity slot antenna 1-1 adopts two orthogonal rectangular radiating slots 1-11 and 1-12 whose length is ⅜ to ⅝ times the wavelength of free space to radiate energy to the free space. The two orthogonal radiating slots of SIW circular cavity slot antenna 1-1 are slotted in the second copper metal layer 1-13 and located in inner circular rings.

The coaxial cavity slot antenna 1-2 can be made up of the first copper metal layer 1-15, the dielectric substrate layer 1-14, the second copper metal layer 1-13, the metallized vias 1-17 located in inner circular rings and the metallized vias 1-16 which is located in outer circular rings. The coaxial cavity slot antenna 1-2 adopts two orthogonal rectangular radiating slots 1-21 and 1-22 whose length is ⅜ to ⅝ times the wavelength of free space to radiate energy to the free space. The two orthogonal radiating slots 1-21 and 1-22 are slotted in the second copper metal layer 1-13 and located between the inner circular ring and the outer circular ring.

Based on the above radiation structure, the corresponding feed structure forms are diverse. Coaxial feed structure can be used for both high and low frequency antennas, as well as the combination of coaxial line and SIW waveguide slot, and SIW waveguide slots combination. Furthermore, the antenna array based on this structure can be expanded to 4×4, 8×8 or even larger in order to obtain higher gain and other requirements.

The working principle of this embodiment is as follows: based on the concept of structure reuse, the high-frequency SIW circular cavity radiator constitute the inner conductor of the low-frequency coaxial cavity radiator, without increasing the occupation area and improving the utilization efficiency of the antenna aperture. In addition, by the high-pass characteristic of SIW, the channel isolation between higher and lower frequency antennas can be improved.

In conclusion, the beneficial effects of this embodiment are as follows: based on the concept of structure reuse, the high-frequency SIW circular cavity radiator constitute the inner conductor of the low-frequency coaxial cavity radiator, without increasing the occupation area and improving the utilization efficiency of the antenna aperture. In addition, the feeding structure is diverse and can be combined in coaxial line and SIW waveguide slots. By the high-pass characteristic of SIW, the channel isolation between higher and lower frequency antennas can be improved.

Example 2

Figure 4:
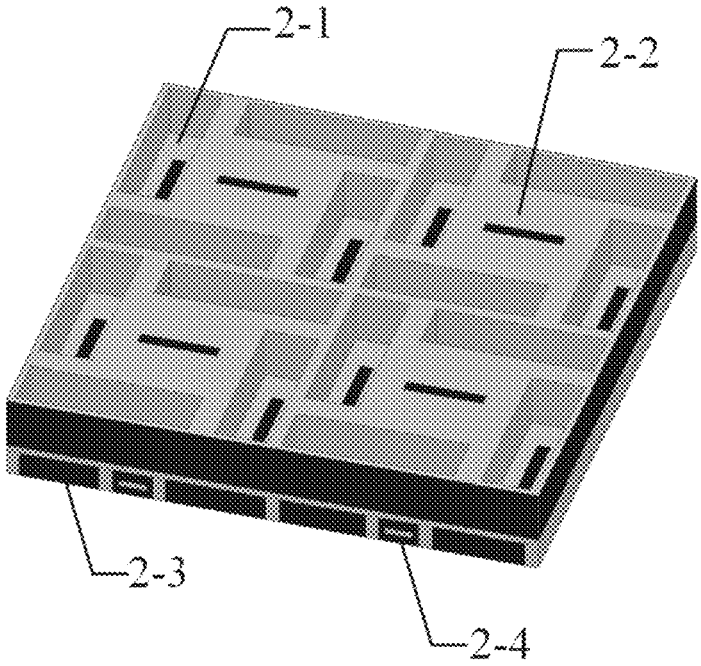
FIG. 4 shows the overall schematic of the dual-band shared-aperture antenna array with structure-reused technology in Example 2.

A dual-band rectangular waveguide shared-aperture antenna array with structure-reused technology is presented, whose 2×2 radiation structure is shown in FIG. 4. And every antenna element comprises: four rectangular waveguide antennas 2-1 and a cavity slot antenna 2-2. In this embodiment, the frequency ratio of the antennas can be chosen between 1 and 4. The rectangular waveguide antennas and cavity slot antenna are fused by the structural particularity, without adding additional aperture, and high isolation with the high aperture reuse efficiency is achieved.

Figure 5A:
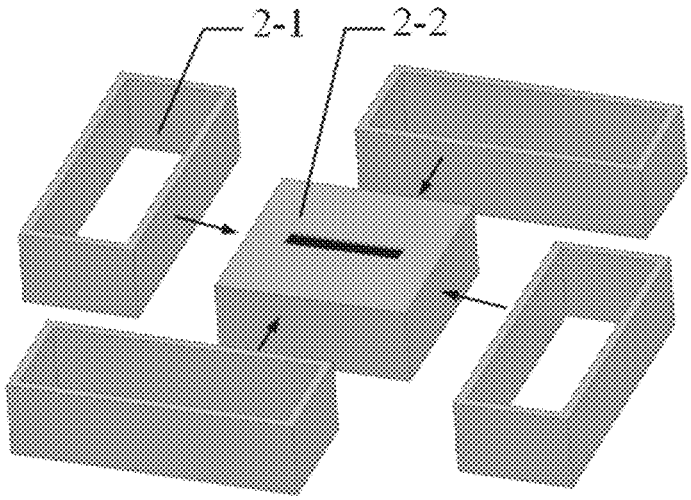
FIGS. 5A-5B show the design principle of the radiation structure for dual-band shared-aperture antenna array with structure-reused technology in Example 2.
Figure 5B:
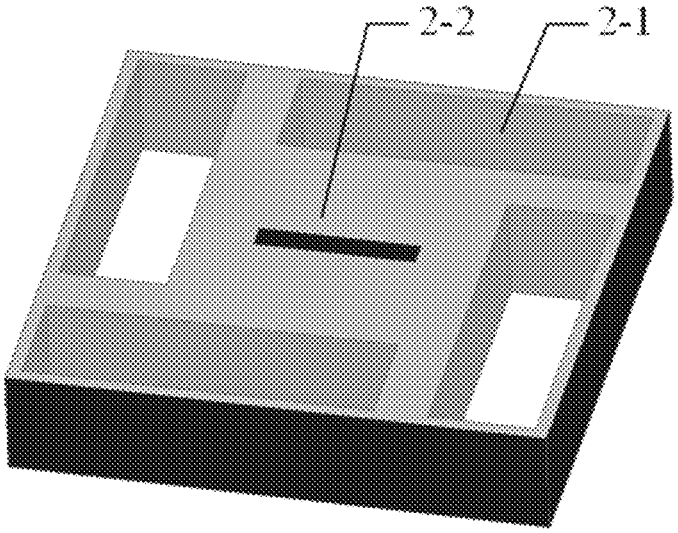

In this embodiment, FIGS. 5A-5B show the configuration of the antenna element, which comprises the first copper metal layer 2-13, the dielectric substrate layer 2-12 and the second copper metal layer 2-11 successively from top to bottom, characterized in that: four rectangular slots with the same size are slotted in the dielectric substrate layer 2-12, and are rotated 90 degrees in sequence by taking the center of the dielectric layer as the center. These rectangular slots run through the second copper metal layer 2-11, the dielectric substrate layer 2-12 and the first copper metal layer 2-13. The inner walls of each rectangular slot are metallized, and form the rectangular waveguide antenna. The radiating slot 2-21 are slotted in the center of the second copper metal layer. Four rectangular waveguide antennas consist of the side wall, and the cavity slot antenna 2-2 is made up of the first copper metal layer 2-13, the dielectric substrate layer 2-12, the second copper metal layer 2-11 and the radiating slot 2-21. The lengths of rectangular radiating slots are ⅜ to ⅝ times the wavelength of free space.

Figure 6A:
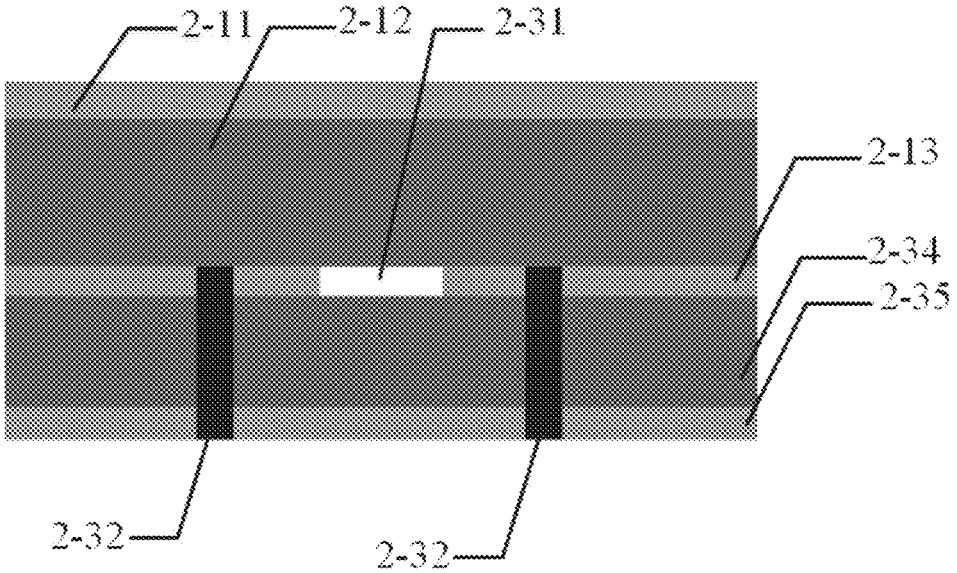
Figure 6B:
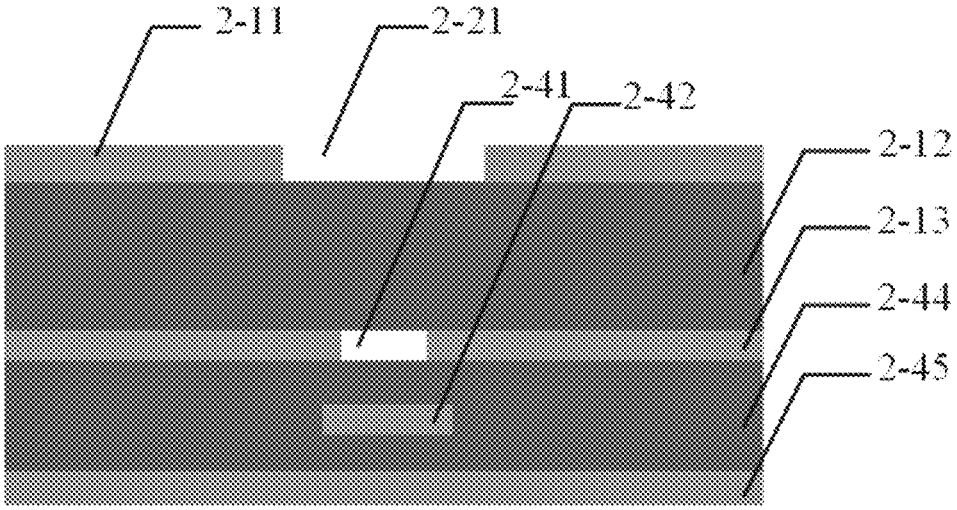

In this embodiment, the rectangular waveguide antenna 2-1 is fed by the SIW waveguide 2-3, which comprises the first copper metal layer 2-35, the dielectric substrate layer 2-34 and the second copper metal layer 2-13 successively from top to bottom. The metallized vias 2-32 on both sides form SIW. Coupling slot 2-31 is etched on copper metal layer 2-13, energy from the slot 2-31 coupled to the rectangular waveguide, as shown in FIG. 6A. The cavity backed slot antenna 2-2 is fed by the strip line 2-4, which comprises the first copper metal layer 2-45, the dielectric substrate layer 2-44 and the second copper metal layer 2-13 successively from top to bottom. The coupling slot 2-41 is etched on copper metal layer 2-13. The feed signal is input from the microstrip line 2-42 and coupled to the back-cavity slot antenna through the slot 2-41, as shown in FIG. 6B. To be sure, the rectangular slot in rectangular waveguide antenna 2-1 should be through the copper metal layer. But in this implementation, since the copper metal layer 2-13 is the common structure of the first copper metal layer of antenna, the second copper metal layer of the SIW feed structure and the second copper metal layer of the strip line, the rectangular slot is not directly penetrated through it. When other feed structures adopted, such as coaxial line, the rectangular slot is not directly penetrated through copper metal layer 2-13.

Figure 7:
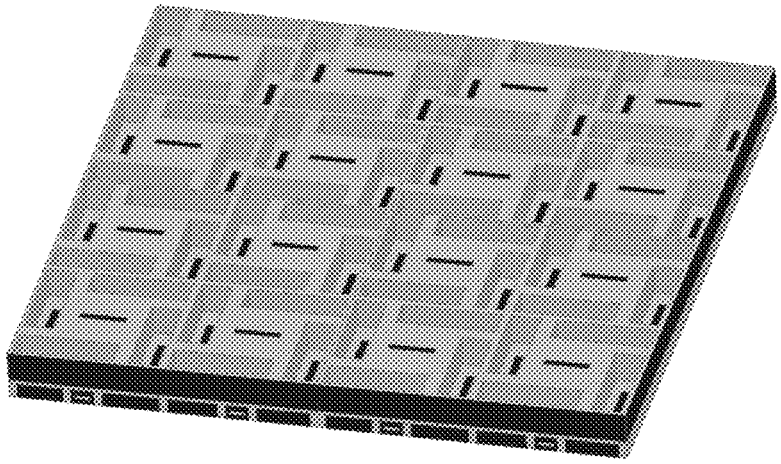
FIG. 7 shows the configuration of the 4×4 dual-band shared-aperture antenna array with structure-reused technology in Example 2.

Based on the above radiation structure, the corresponding feed structure forms are diverse. Coaxial feed structure can be used for rectangular waveguide antennas, while coaxial line, SIW slot or microstrip line coupling slot can also be used to feed the cavity backed slot antenna. Furthermore, the frequency ratio of the antennas can be chosen between 1 and 4, and the antenna array based on this structure can be expanded to 2×2, 4×4, 8×8 or even larger in order to obtain higher gain and other requirements. FIG. 7 shows a 4×4 dual-band shared-aperture antenna.

The working principle of this embodiment is as follows: due to the close structure, the four rectangular waveguide antennas which rotate 90° successively under the given frequency band form the side wall of the cavity backed antenna of another frequency band, and then a radiation slot at the center of the cavity backed form the cavity slot antenna. SIW and ribbon line can be used to feed rectangular waveguide antenna and cavity backed slot antenna respectively, dual-band antenna can be realized under the reuse of rectangular waveguide structure. There is no extra distance between antenna elements, less area is occupied, and the frequency ratio can be adjusted between 1 and 4. In addition, by the high-pass characteristic of waveguide and orthogonal polarizations of dual-band antennas, the channel isolation between higher and lower frequency antennas can be improved.

In conclusion, the beneficial effects of this embodiment are as follows: based on the concept of structure reuse, the rectangular waveguide antenna forms the side wall of the back-cavity slot antenna. Compared with the staggered layout, the antennas occupy less area and the utilization rate of the antenna aperture increases. In addition, the feed structure of this embodiment is separated, and antennas of different frequencies can work independently and simultaneously without affecting each other. By the high-pass characteristic of SIW, the channel isolation between higher and lower frequency antennas can be improved.

Example 3

Figure 8:
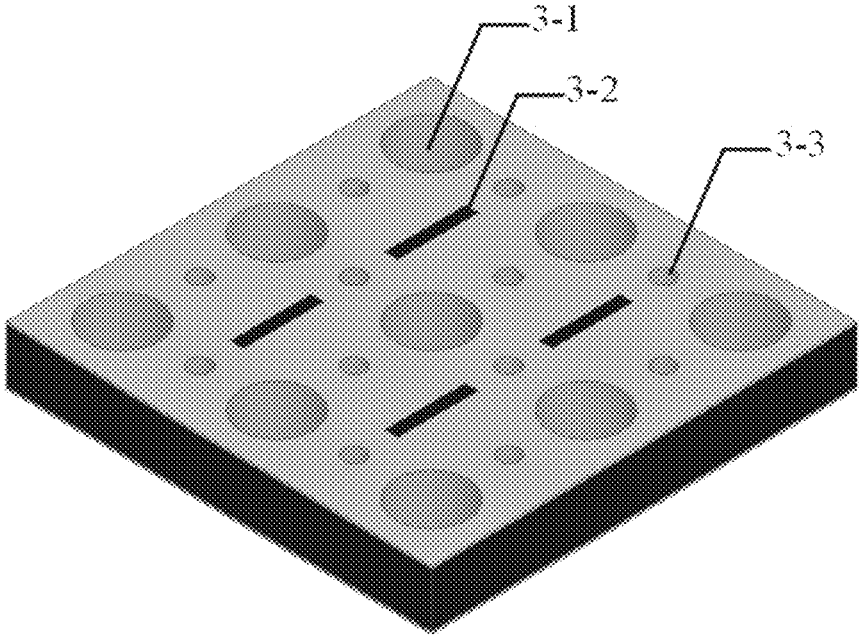
FIG. 8 shows the overall schematic of the dual-band shared-aperture antenna array with structure-reused technology in Example 3.

A dual-band circular waveguide shared-aperture antenna array with structure-reused technology is presented, whose 2×2 radiation structure is shown in FIG. 8. And every antenna element comprises: four circular waveguide antennas 3-1, four auxiliary structures and a cavity slot antenna. In this embodiment, the frequency ratio of the antennas may be even or non-even. The circular waveguide antennas and cavity slot antenna are fused by the structural particularity, without adding additional aperture. By the high-pass characteristic of circular waveguide and close structure, the channel isolation between higher and lower frequency antennas can be improved.

Figure 9A:
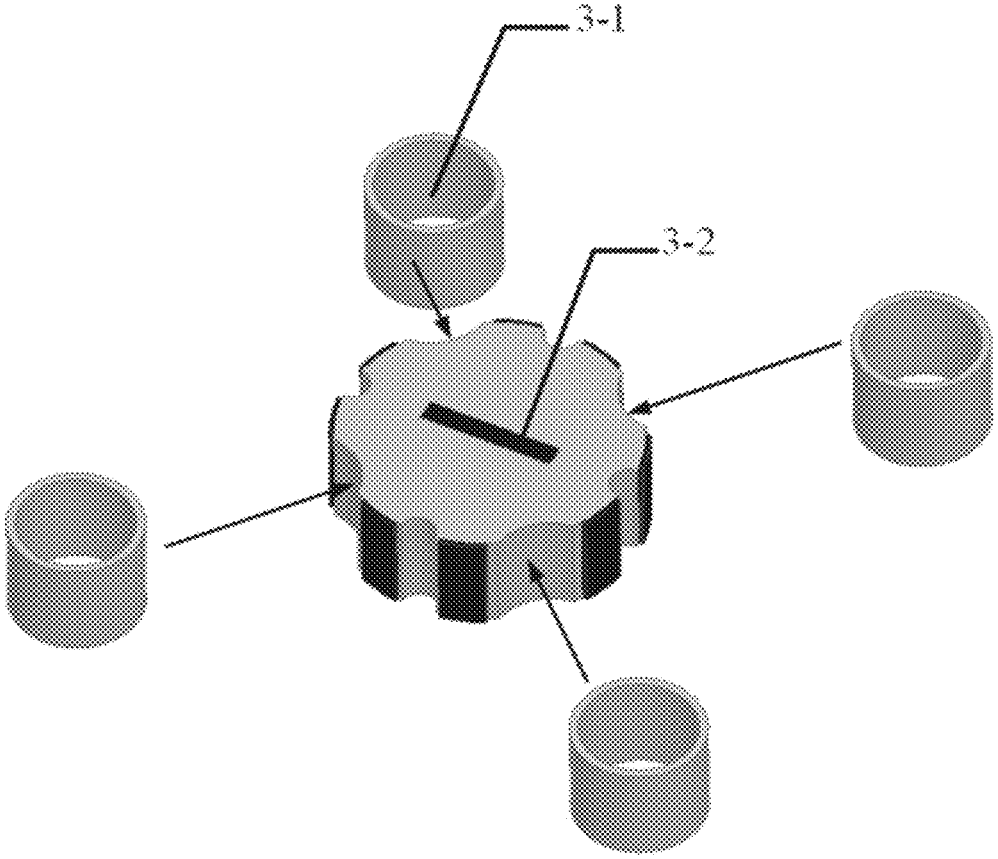
FIGS. 9A-9B show the design principle of the radiation structure for dual-band shared-aperture antenna array with structure-reused technology in Example 3.
Figure 9B:
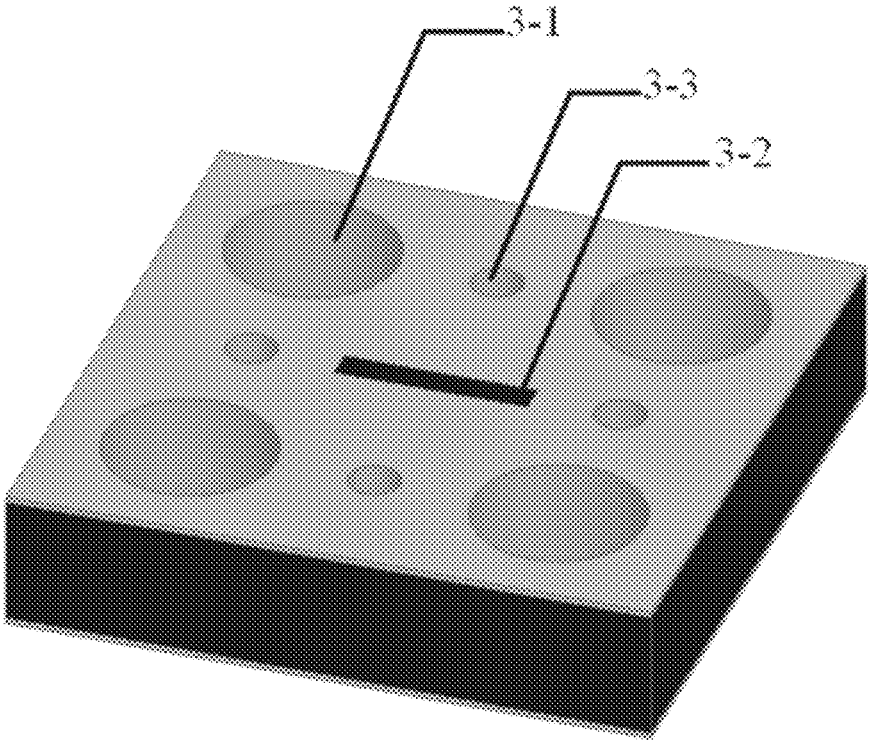
Figure 10:
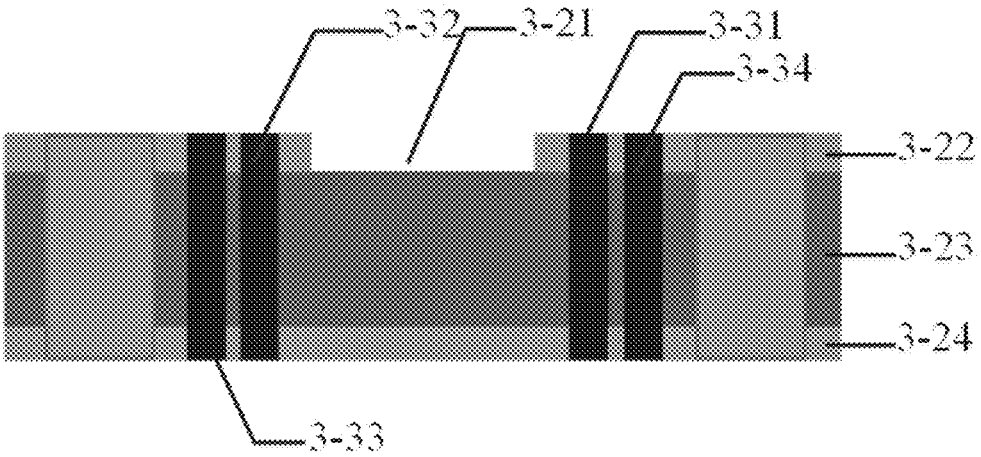
FIG. 10 shows a section view of the dual-band shared-aperture antenna array with structure-reused technology in Example 3.

In this embodiment, FIGS. 9A-9B show the configuration of the antenna element, which comprises the first copper metal layer 3-24, the dielectric substrate layer 3-23 and the second copper metal layer 3-22 successively from top to bottom, characterized in that: four circular slots with the same size are slotted in the dielectric substrate layer 3-23, and are located in four corners of this substrate layer respectively. These circular slots run through the second copper metal layer 3-22, the dielectric substrate layer 3-23 and the first copper metal layer 3-24. The inner wall of each circular slot is metallized, and form the circular waveguide antenna 3-1. Assistant metallized vias 3-3 are disposed between two adjacent circular waveguide antennas. These metallized vias 3-31, 3-32, 3-33, 3-34 run through the first copper metal layer 3-24, the dielectric substrate layer 3-23 and the second copper metal layer 3-22. The radiating slot 3-21 is slotted in the center of the second copper metal layer. Four circular waveguide antennas and four assistants metallized vias are used as the side wall. The cavity slot antenna 3-2 is made up of the first copper metal layer 3-24, the dielectric substrate layer 3-23, the second copper metal layer 3-22 and the radiating slot 3-21. The lengths of rectangular radiating slots are ⅜ to ⅝ times the wavelength of free space.

Figure 11:
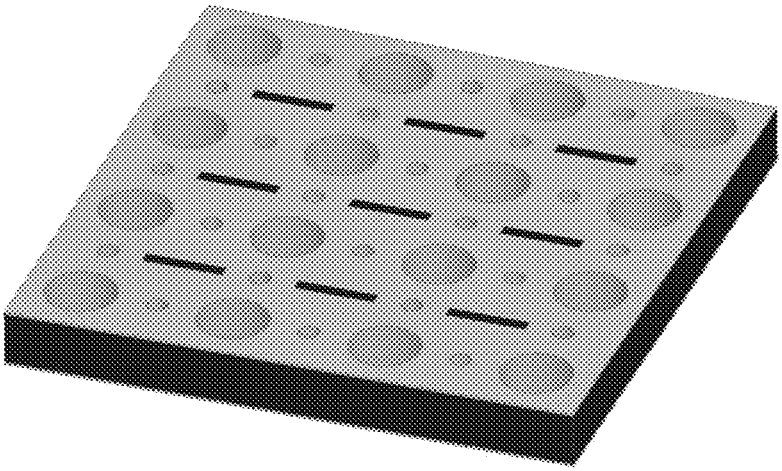
FIG. 11 shows the overall schematic of the 3×3 dual-band shared-aperture antenna with structure-reused technology in Example 3.

Based on the above radiation structure, the corresponding feed structure forms are diverse. Coaxial and SIW slots can be used to feed circular waveguide antennas, while the coaxial line, SIW slot or microstrip line coupling slot can also be used to feed the cavity backed slot antenna. In addition, according to the required frequency, the waveguide antenna can be filled with dielectric or not, and the frequency ratio of the antennas may be even or non-even. Furthermore, the number and spacing of circular waveguide antennas can be appropriately increased according to the requirements of frequency ratio, and the number of metallized vias in the auxiliary structure can also be increased or decreased according to actual needs, and the number of cavity backed slot can also be increased to double or multiple slots as required. The antenna array based on this structure can be expanded to 2×2, 3×3, 4×4 or even larger in order to obtain higher gain and other requirements. FIG. 11 shows a 4×4 dual-band shared-aperture antenna.

The working principle of this embodiment is as follows: due to the close structure, the four circular waveguide antennas working in a certain frequency band and the auxiliary metallized vias between them constitute the side wall of the back-cavity antenna in another frequency band, and then a radiation slot at the center of the cavity backed form the cavity slot antenna. Adjusting the distance between the circular waveguides can change the frequency ratio of the dual-band antenna. There is no extra distance between antenna elements, less area is occupied, and the frequency ratio can be adjusted between 1 and 4. In addition, by the high-pass characteristic of circular waveguide and close structure, the channel isolation between higher and lower frequency antennas can be improved.

In conclusion, the beneficial effects of this embodiment are as follows: based on the concept of structure reuse, the circular waveguide antenna and auxiliary structures form the side wall of the back-cavity slot antenna, the frequency ratio of the antennas may be even or non-even. Compared with the staggered layout, the antennas occupy less area and the utilization rate of the antenna aperture increases. In addition, the feed structure of this embodiment is separated, and antennas of different frequencies can work independently and simultaneously without affecting each other. By the high-pass characteristic of circular waveguide and close structure, the channel isolation between higher and lower frequency antennas can be improved.

Example 4

Figure 12:
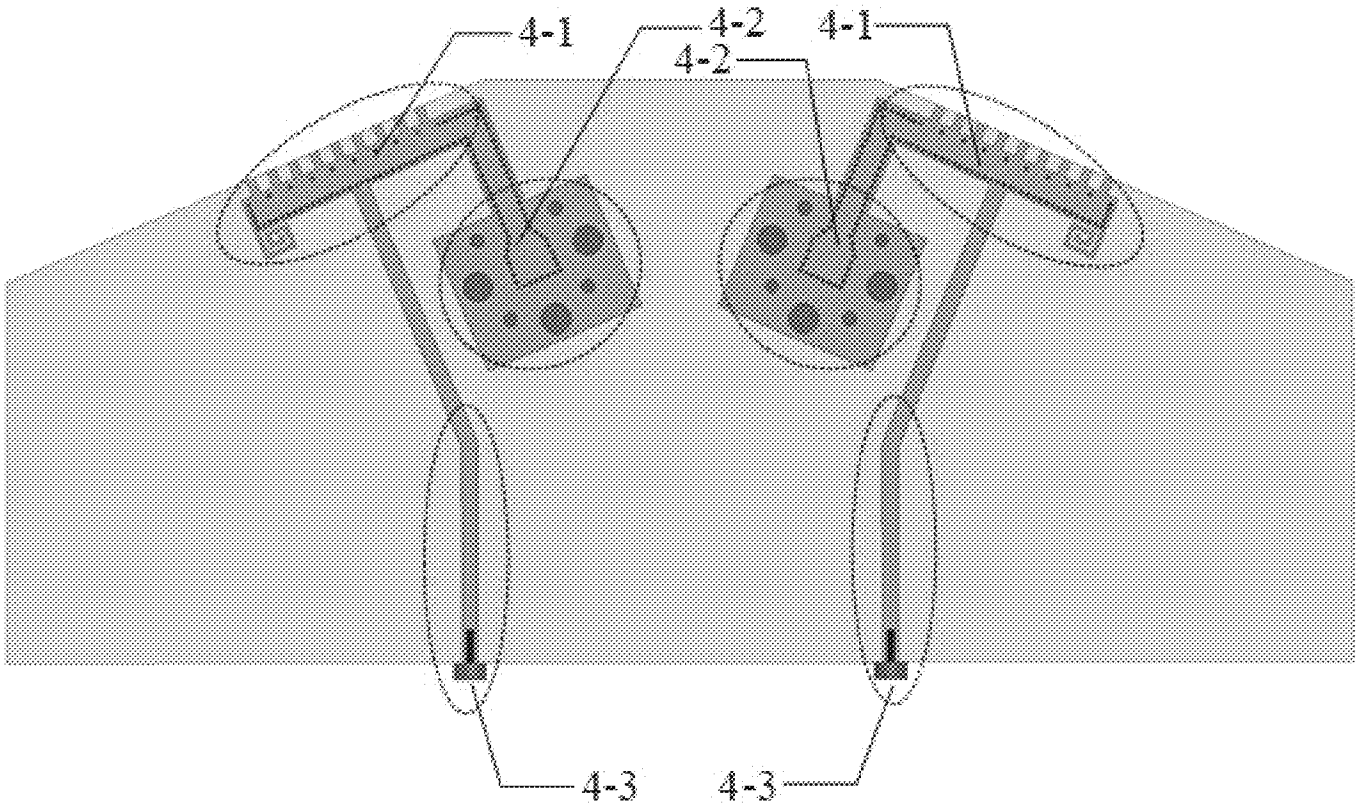
FIG. 12 shows a top view of the two elements tri-band shared-aperture antenna with structure-reused technology in Example 4.
Figure 13:
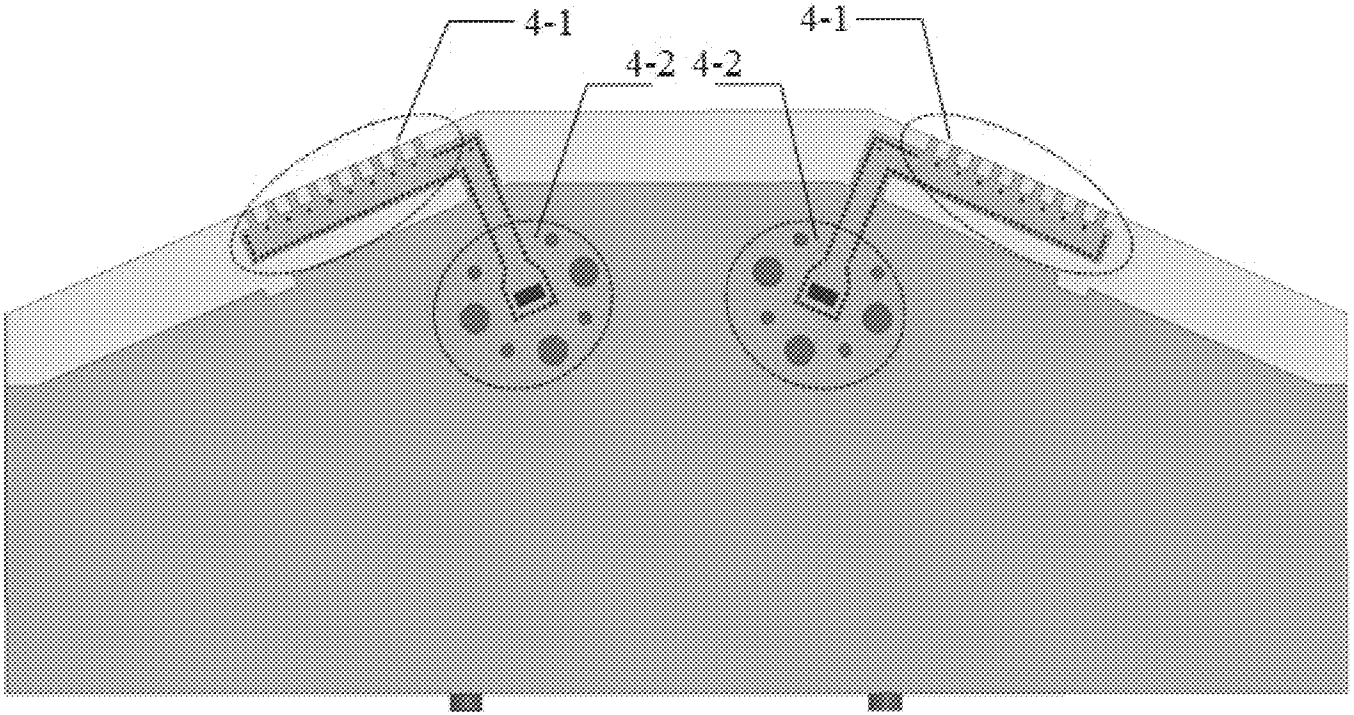
FIG. 13 shows a bottom view of the two elements tri-band shared-aperture antenna with structure-reused technology in Example 4.

As shown in FIG. 12 and FIG. 13, a two elements tri-band shared-aperture antenna array with structure-reused technology is presented, which comprises antennas 4-1, waveguide feed structures 4-2 and microstrip line feed structures 4-3. In this embodiment, the overall size of the antenna is 161.5 mm×70 mm×1.016 mm, and the working frequencies are S-band (2.4 GHz), C-band (5.2 GHz) and V-band (57 GHz-64 GHz). Among them, PIFA element radiates S-band and C-band signals, and SIW leaky wave antenna radiates V-band signal. Two kind of antennas are fused by the structural particularity, without adding additional aperture. By the high-pass characteristic of circular waveguide and close structure, the channel isolation between higher and lower frequency antennas can be improved.

Figure 14:
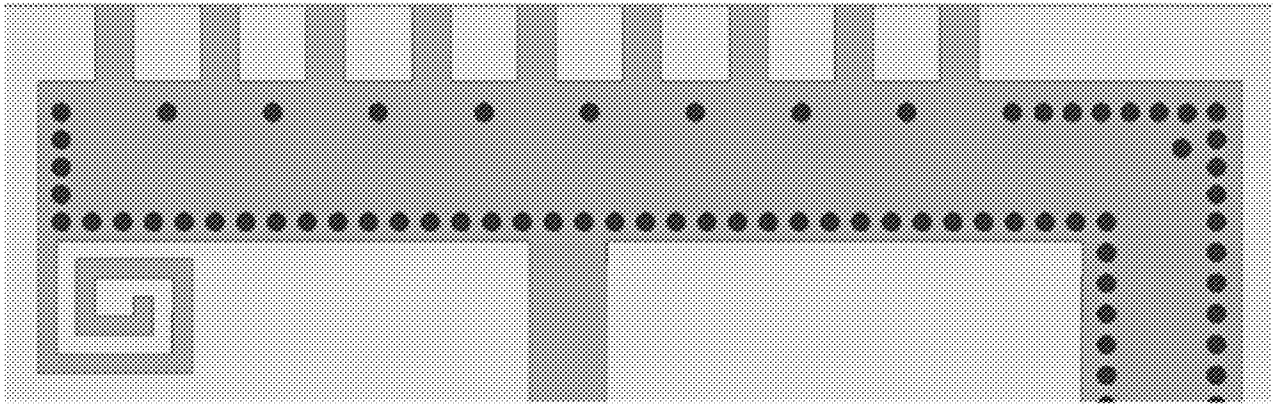
FIG. 14 shows a top view of radiation structure of the two elements tri-band shared-aperture antenna with structure-reused technology in Example 4.
Figure 15:
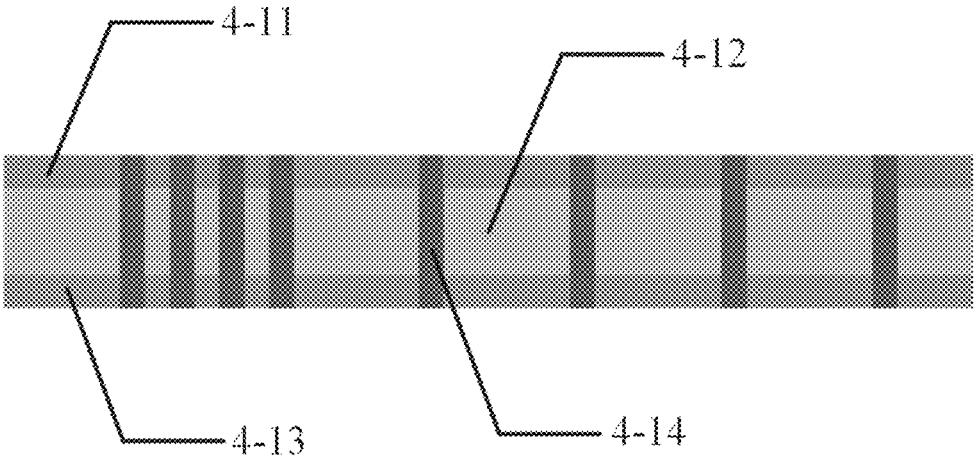
FIG. 15 shows a section view of radiation structure of the two elements tri-band shared-aperture antenna with structure-reused technology in Example 4.

In this embodiment, a shared-aperture antenna comprises the first copper metal layer 4-13, the dielectric substrate layer 4-12 and the second copper metal layer 4-11 successively from top to bottom. As shown in FIG. 14, the printed inverted-F (PIFA) antenna comprises the rectangular monopole with a size of 31.32 mm×6.78 mm, the spiral line with a size of 19 mm×0.5 mm and nine rectangular stubs with a size of 2 mm×1 mm. The comb structure made up of the rectangular monopole and rectangular stubs is connected to the first copper metal layer 4-13 by the metallized via 4-14 run through the dielectric substrate layer 4-12, and then they consist of the SIW leaky-wave antenna. The diameter of adjacent metallized vias located at the radiating edge is 0.5 mm and the spacing is 2.7 mm, the diameter of the remaining metallized vias is 0.5 mm and the spacing of the vias is 0.8 mm, and the diameter of tuned holes is 0.4 mm. In this embodiment, the relative dielectric constant of the substrate is 2.2, the thickness is 1.016 mm, and the upper and lower metal layers are 0.5 ounces thick.

Figure 16:
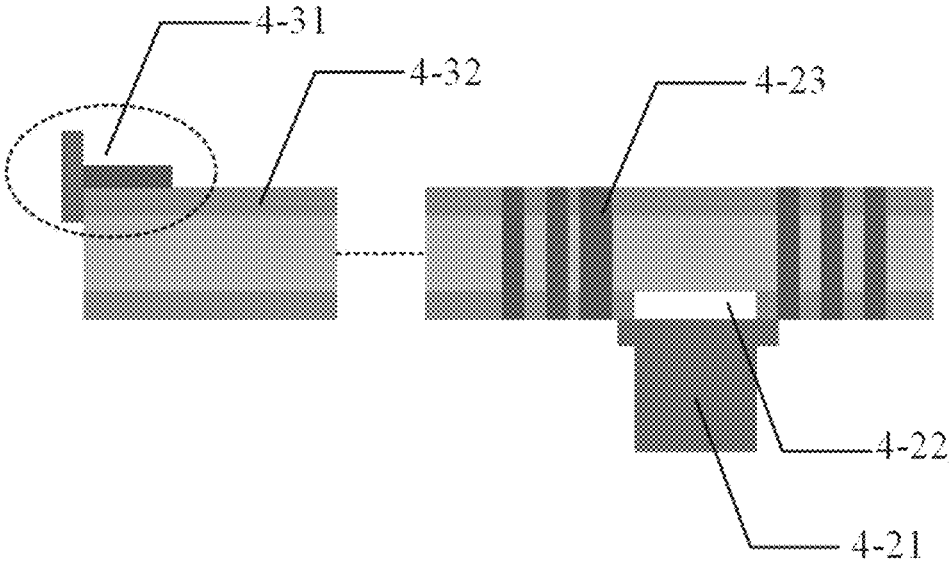
FIG. 16 shows a section view of feed structure of the two elements tri-band shared-aperture antenna with structure-reused technology in Example 4.

The waveguide feeding structure 4-2 comprises the waveguide 4-21 and its waveguide to SIW transition structure. Rectangular slot 4-22 is etched on the first copper metal layer 4-13 to ensure energy feeding into SIW leaky wave antenna. As shown in FIG. 16, the waveguide to SIW transition structure is made up of the metallized vias 4-23 which run through the dielectric substrate layer 4-12 and the rectangular slot 4-22 which is slotted in the first copper metal layer. The waveguide is disposed under the first copper metal layer 4-13.

The microstrip feeding structure on the dielectric substrate layer is used to feed the PIFA antenna. This microstrip feeding structure 4-3 comprises the SMA connector 4-31 and the microstrip line 4-32. The microstrip line 4-32 is connected to the rectangular monopole to feed the antenna.

Figure 17A:
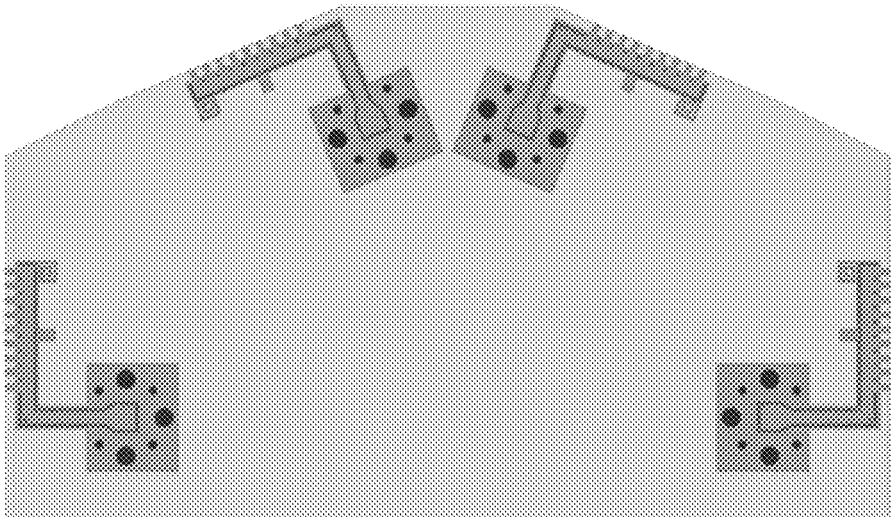
FIGS. 17A-17B show top views of the tri-band structure-reused shared-aperture antenna with four elements and eight elements in Example 4.
Figure 17B:
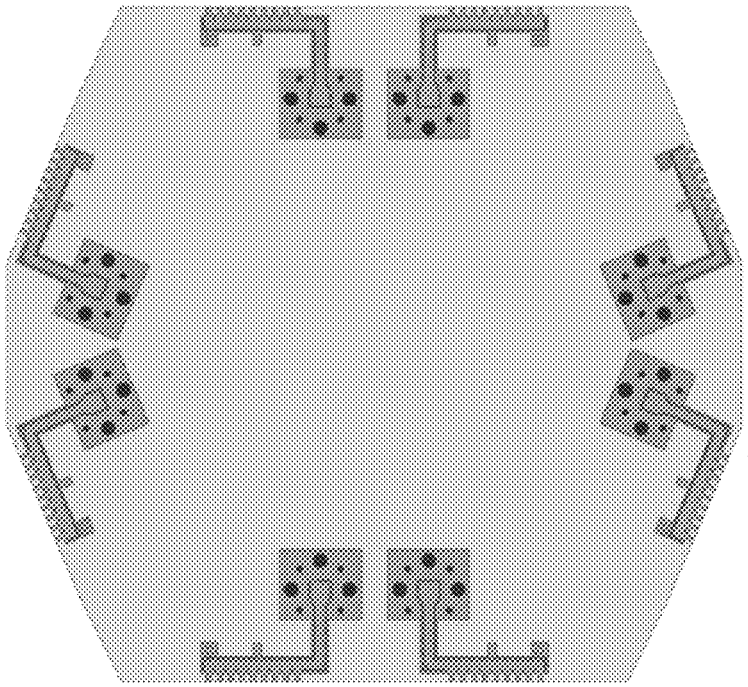

Further, the antenna array based on this structure can be expanded to 4, 8, 16 or more elements, so as to obtain larger beam coverage range of Wi-Gig frequency band and finally achieve omni-directional coverage. The schematic diagram of the structure is shown in FIGS. 17A-17B.

The working principle of this embodiment is as follows: since the structure of the substrate integrated waveguide is closed, the millimeter wave signal has less interference to the PIFA antenna. SIW leaky wave antenna for Wi-Gig application integrate with PIFA for Wi-Fi application, namely the lower metal and dielectric layer and the metal copper clad layer and metal via constitute the radiator of both as SIW leaky wave antennas, and as the PIFA.

Then high frequency signals are fed by waveguide feed structure and low frequency signals by microstrip feed structure respectively to realize three frequency radiation under the same radiation structure In conclusion, the beneficial effects of this embodiment are as follows: based on the concept of structure reuse, the antennas occupy less area and the utilization rate of the antenna aperture increases. In addition, the feed structure of this embodiment is separated, and antennas of different frequencies can work independently and simultaneously without affecting each other. At the same time, the high gain in a certain beam coverage range is achieved by SIW leaky wave antenna. In this embodiment, the MIMO technology and the Wi-Fi technology are combined, and a tri-band antenna with structure-reused technology are used to improve the channel capacity of the Wi-Fi band, and the different antennas are independently and simultaneously operated. And a plurality of high frequency antennas further expands the beam coverage of the Wi-Gig band antenna, and finally achieve a higher gain and a larger beam range.

Example 5

A miniaturized high isolated shared-aperture antenna with structure-reused technology is provided, and its operating frequencies are sub-6G band (3.4 GHz-3.6 GHz) and millimeter-wave band (37.7 GHz-39.0 GHz) in next generation wireless communication. Antenna is shown in FIGS. 18A-18E.

The substrate integrated waveguide cavity slot antenna adopts a square structure, and the middle copper metal layer 5-3, the upper dielectric layer 5-2, the second copper metal layer 5-1 and the first metallized vias 5-11 form eight SIW cavity arranged as a 2×4 matrix. In every SIW cavity, the second copper metal layer 5-1 etched the radiation slots 5-1-1, as shown in FIG. 18B, and the middle copper metal layer 5-3 etched the radiation slots 5-3-1, as shown in FIG. 18C.

Figure 18A:
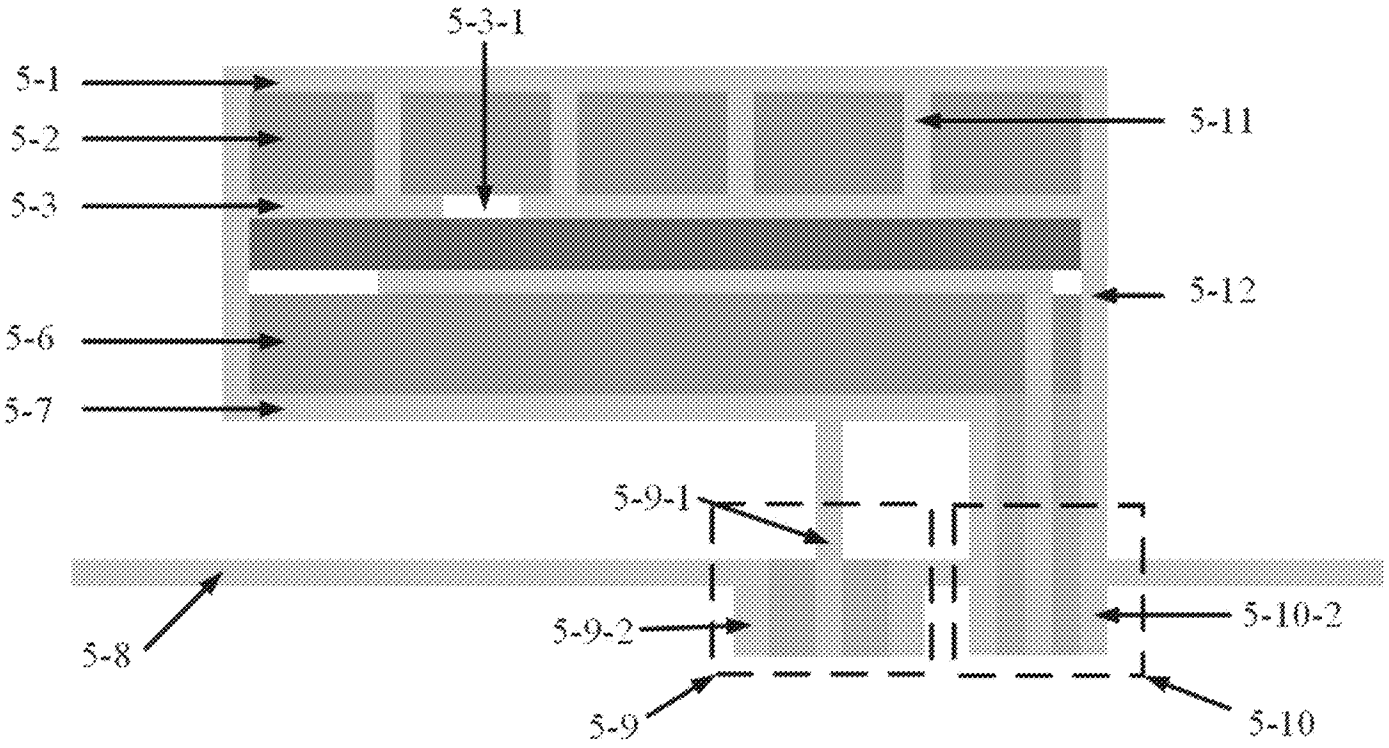
Figure 18B:
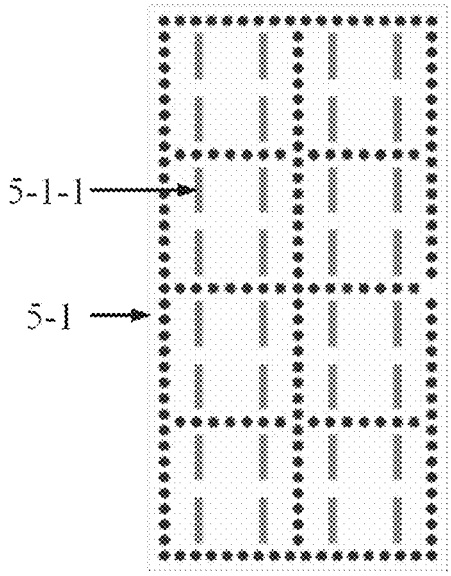
Figure 18C:
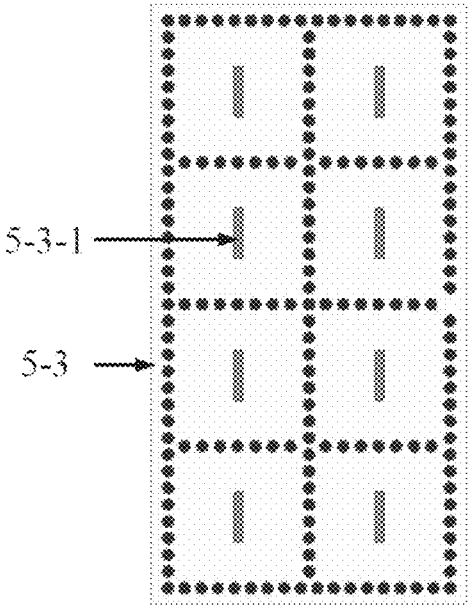
Figure 18D:
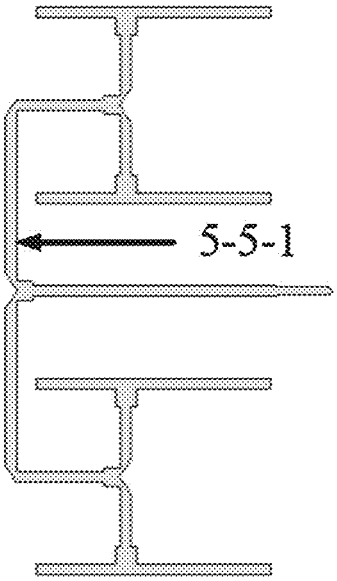
Figure 18E:
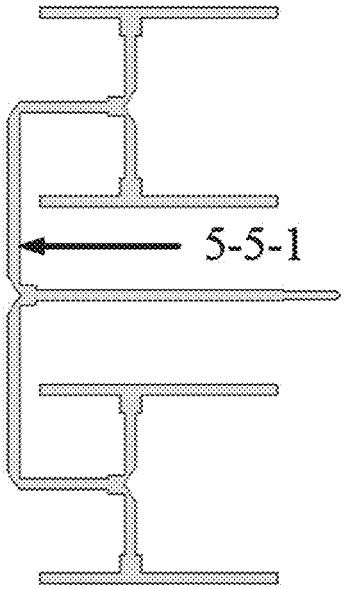

The patch antenna adopts a square structure, and the second metal vias 5-12 are arranged along the edge of the lower dielectric layer 5-6 as shown in FIG. 18E. The second metal vias 5-12 is located at the edge of the upper dielectric layer 5-2. The first metal vias 5-11 and the second metal vias 5-12 have the same horizontal position, corresponding to the upper and lower sides, as shown in FIG. 18A.

The feed network is strip line 5-5-1, as shown in FIG. 18D.

The SIW waveguide cavity slot antenna is fed by coaxial line, and the inner conductor 5-1-1 of the coaxial connector 5-10 penetrates the first copper metal layer 5-7 and the lower dielectric layer 5-6, and connected to strip line 5-5-1 to feed the SIW; The outer conductor 5-10-2 of the coaxial feeding connector 5-10 is connected to the first copper metal layer 5-7 and the metal ground 5-8, and serves as a short-circuit structure of the patch antenna to achieve the purpose of miniaturizing the patch antenna, as shown in FIG. 18A.

The patch antenna is fed by coaxial line, and the inner conductor 5-9-1 of the coaxial feed connector 5-9 is connected to the first copper metal layer 5-7, and the outer conductor 5-9-2 of the is connected to metal ground 5-8, as shown in FIG. 18A.

Figure 19A:
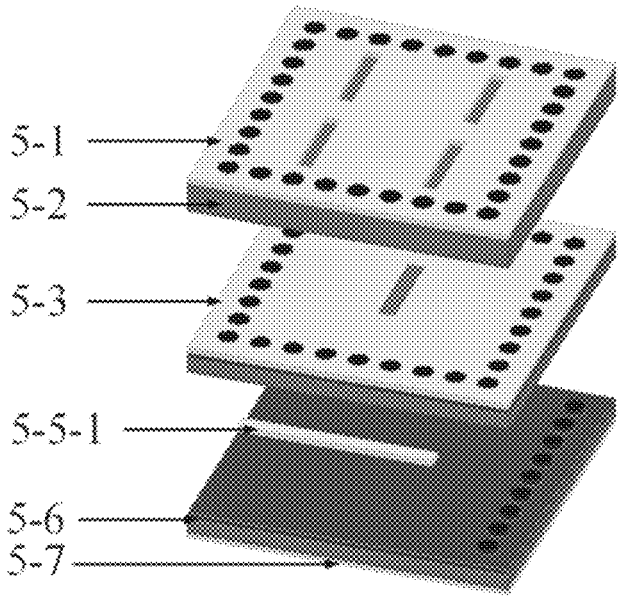
FIGS. 19A-19C shows the configuration of the high-frequency element of miniaturized and high isolated shared-aperture antenna with structure-reused technology in Example 5.
Figure 19B:
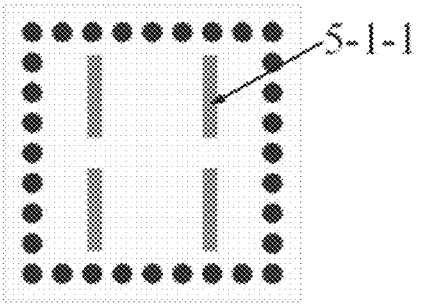
Figure 19C:
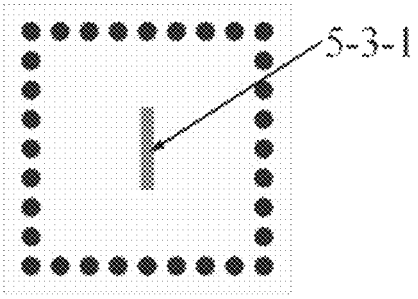

FIGS. 19A-19C shows the configuration of the high-frequency element. The millimeter wave signal is coupled to the excite SIW cavity through the strip line 5-5-1 and the slot 5-3-1, and then radiated out through the slot 5-1-1.

In this embodiment, the 2×4 high frequency antenna arrays together form a low frequency element, which is fed by the coaxial connector 5-10; The coaxial connector 5-10 is a short circuit structure of the low frequency patch antenna, as shown in FIG. 18 E. The coaxial connector 5-10 is located at the center point of the right edge of the entire structure. The size of the conventional high frequency antenna on the low frequency patch antenna is 4×4, and the center of the patch antenna is the electric field zero point. If the short-circuit structure is loaded there, the patch antenna area is reduced by half while the resonant frequency is constant. As shown in FIGS. 18A-18E, the left side of the patch antenna is the equivalent magnetic flux radiant side, and the short-circuit point is located on the right side of the patch antenna.

Figure 20A:
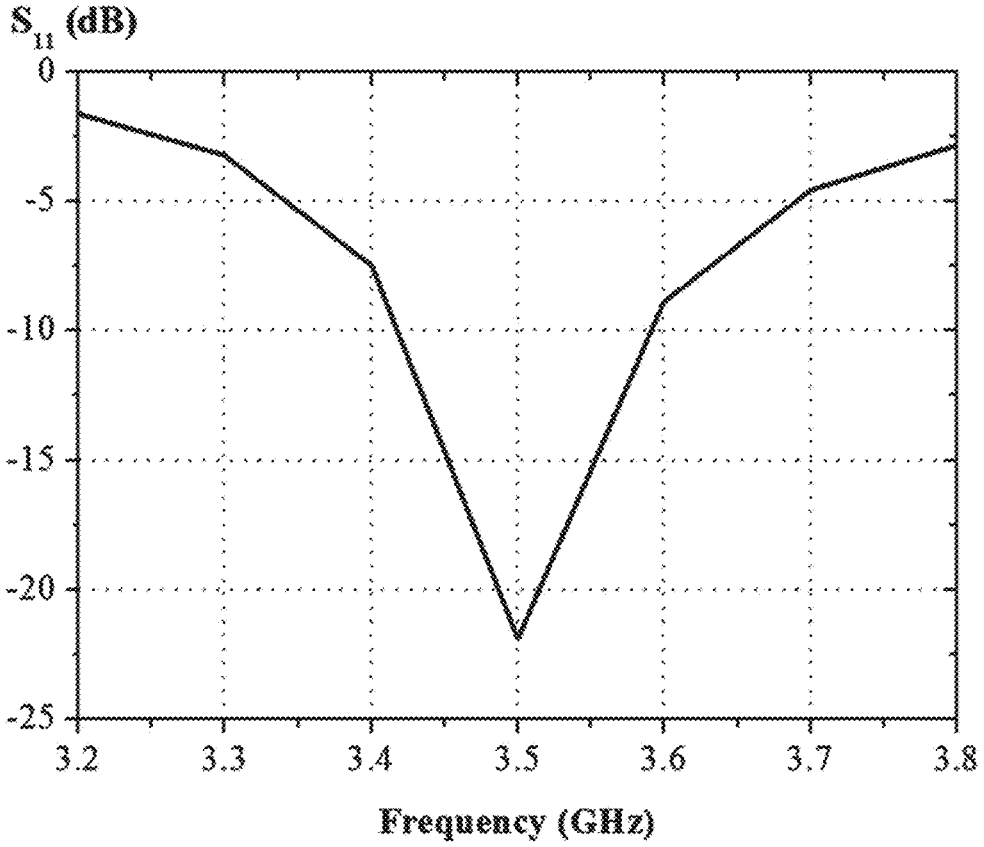
Figure 20B:
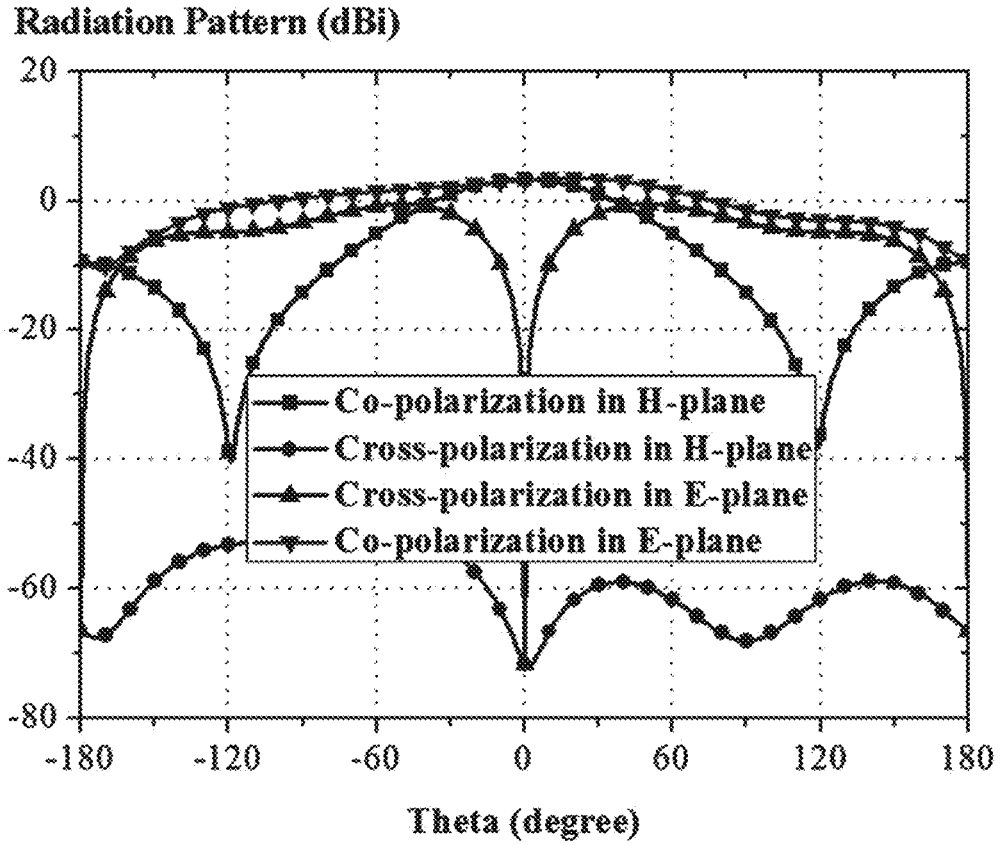
Figure 21A:
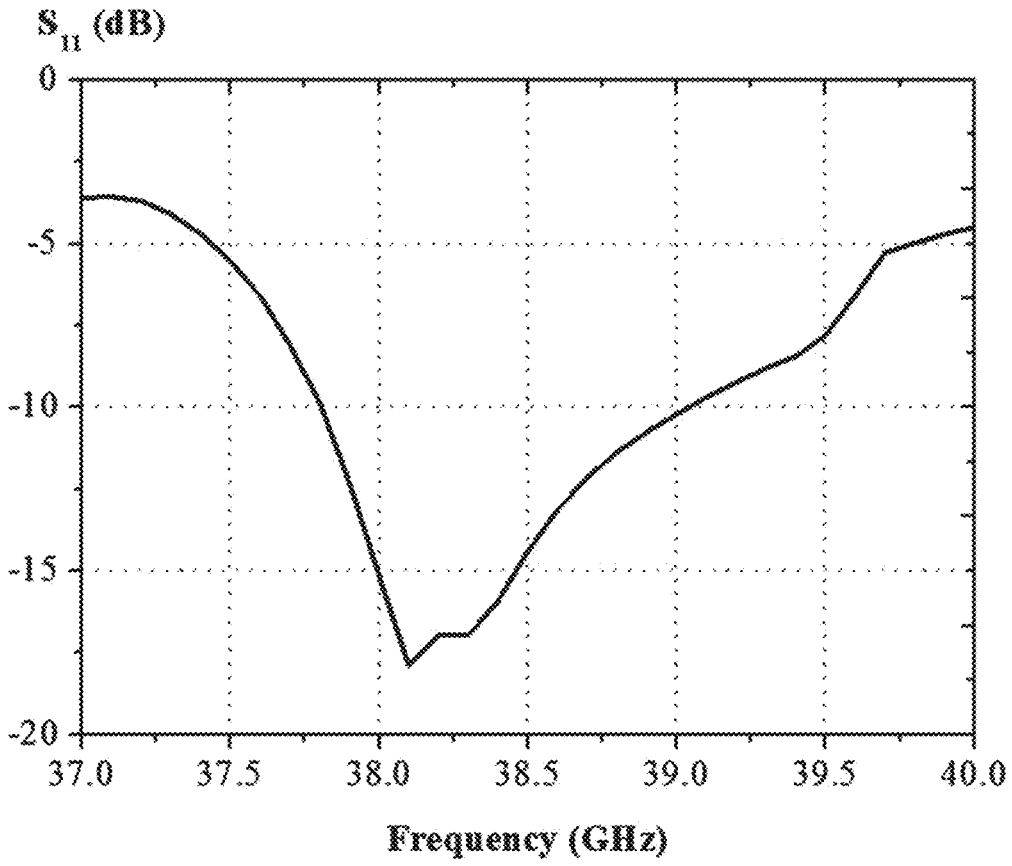
Figure 21B:
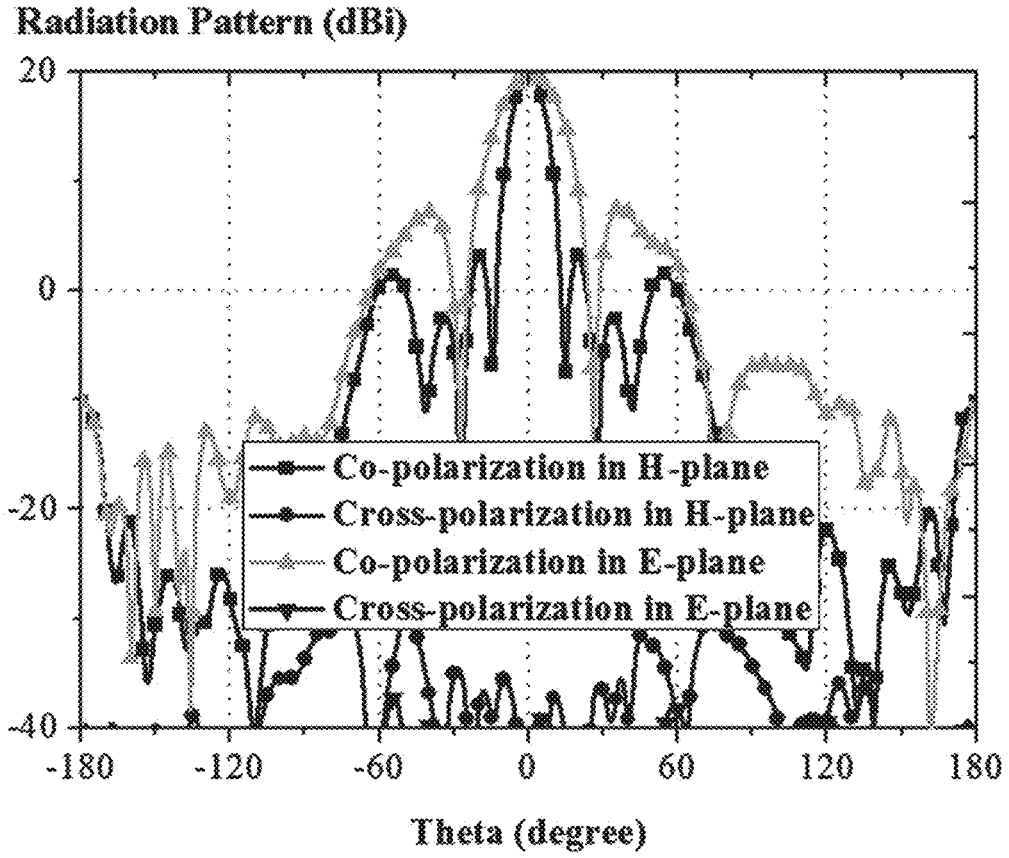
Figure 22A:
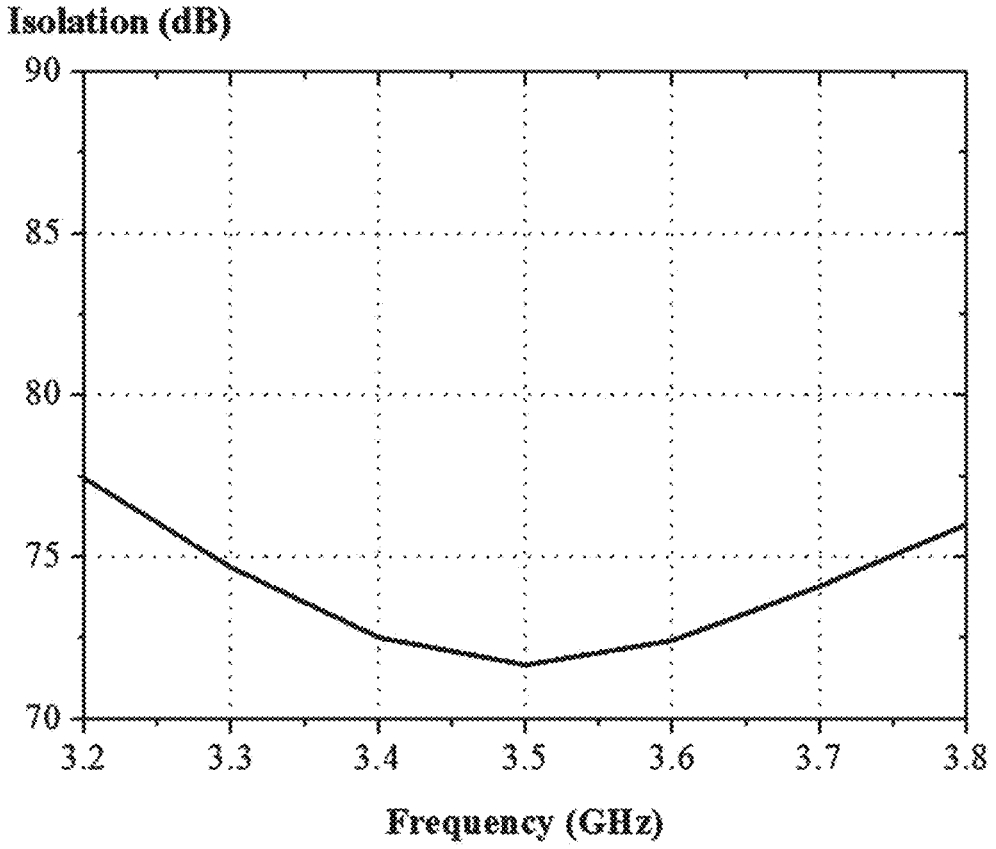
FIGS. 22A-22B show the isolation between antennas with different bands in Example 5.
Figure 22B:
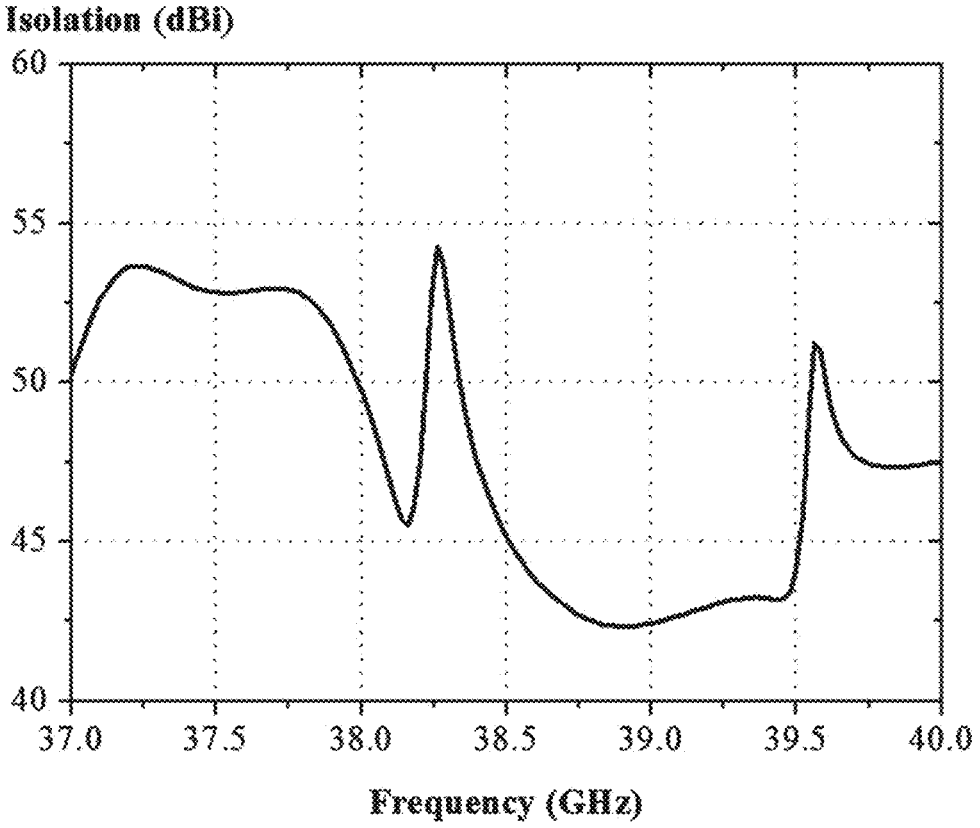

Further, in this embodiment, the upper dielectric layer 5-2 has a thickness of 0.508 mm and a relative dielectric constant of 2.2, and the lower dielectric layer 5-6 has a thickness of 0.254 mm and a relative dielectric constant of 2.2. Based on these parameters, the dual-band antenna is simulated and tested. FIGS. 20A-20B shows the S-parameter and pattern of the sub-6G antenna. In the 3.4 GHz-3.6 GHz band, the sub-6G patch antenna has a return loss of more than 10 dB, and the maximum gain of 3.5 dBi is achieved at the center frequency (3.5 GHz). FIGS. 21A-21B show the S-parameters and patterns of the millimeter-wave band antenna. In the frequency range of 37.8 GHz-39.0 GHz, the return loss is above 10 dB, and the maximum gain of 19.6 dBi is achieved at the center frequency (38.5 GHz). FIGS. 22A-22B shows the isolation of the above-mentioned miniaturized high-isolation shared-aperture antennas, showing that the isolation of the dual-frequency antenna is higher than 70 dB in the frequency range of 3.4 GHz to 3.6 GHz. In the frequency range of 37.7 GHz to 39.0 GHz, the isolation is higher than 40 dB.

The working principle of this embodiment is that a miniaturized high isolated shared-aperture antenna based on structure-reuse is provided, and the common aperture of sub-6G and millimeter-wave antenna is satisfied on the basis of miniaturized design. Among them, the high-frequency SIW waveguide cavity slot antenna and the feed structure are simultaneously used as a low-frequency patch antenna to realize a shared-aperture design. At the same time, a short-circuited is loaded at the center of the patch to realize miniaturization of the antenna. In summary, the beneficial effects of the embodiment are as follows: 1. Based on the miniaturization technology and the shared-aperture antenna technology, the antenna area of the two frequency bands is minimized. 2. Based on the structure-reuse technology, the high isolation between different bands is realized by using the closed structure.

Example 6

A large frequency ratio shared-aperture antenna with structure-reused technology is presented, and the corresponding structures are shown in FIGS. 23A-23B and FIGS. 24A-24B. They comprise the radiating structure 6-1, the waveguide feeding structure 6-2 and the microstrip feeding structure 6-3. The antenna size is 80 mm×80 mm×2.591 mm, and the operating frequencies is at S-band (3.4-3.5 GHz) and V-band (59-60 GHz). The patch element and the SIW slot array are used for S-band and V-band respectively. They use the structural specificity to make an integration, and realize the high aperture utilization ration and high channel isolation at the operating frequency band.

Figure 23A:
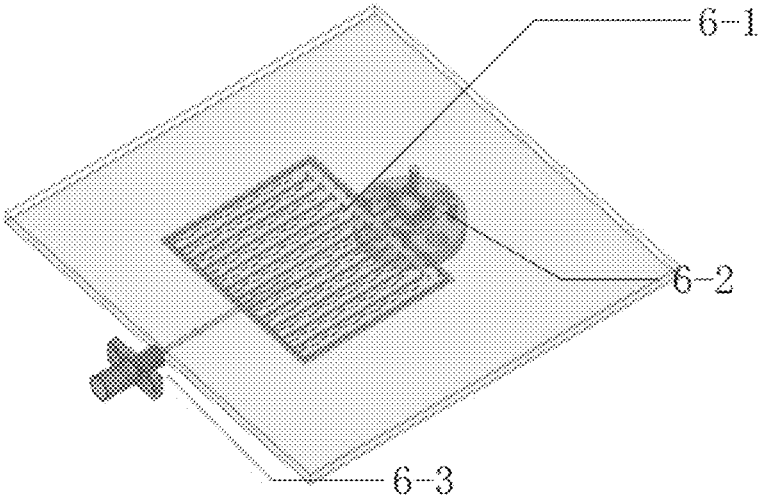
FIGS. 23A-23B show the configuration of the structure-reused shared-aperture antenna with large frequency ratio in Example 6.
Figure 23B:
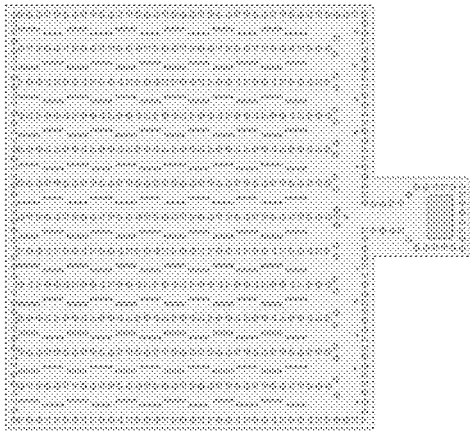

The radiating structure comprises the first dielectric substrate layer 6-17, the second dielectric substrate layer 6-15, the first copper metal layer 6-14, the third dielectric substrate layer 6-13 and the second copper metal layer 6-11 successively from top to bottom. As is shown in FIGS. 23A-23B, a 12×12 SIW slot array is slotted in the second copper metal layer 6-11. The size of each rectangular slot is 1.8 mm×0.2 mm. The adjacent distance of slots in the longitudinal direction is 2.1 mm, and the slot deviates from the center line 0.19 mm. The second copper metal layer 6-11 is connected to the first copper metal layer 6-14 by the metallized via running through the third dielectric substrate layer 6-13. The diameter of the metallized via is 0.5 mm, and the distance between vias is 0.8 mm. The tuning via is also set, and the diameter is 0.3 mm. The SIW slot array antenna comprises the first copper metal layer 6-14, the third dielectric substrate layer 6-13, the second copper metal layer 6-11 and the metallized vias 6-12. These components are used as the patch antenna as well. The relative dielectric constant of dielectric substrates is 2.2. The thickness of the upper and first dielectric substrate layers is 0.508 mm, and the thickness of the middle dielectric substrate is 1.575 mm. The thickness of all copper metal layers is 0.5 oz.

The microstrip structure 6-3 is disposed under the first dielectric substrate layer 6-17, and it comprises the SMA connector and the microstrip line 6-32 which is connected to the SMA. The microstrip line 6-32 comprises the photonic band gap structure 6-33, which is used to isolate the high frequency signal. The microstrip feeding structure is used to excite the patch antenna by the H-shape slot 6-18 which is set in the metal ground 6-16.

Figure 24A:
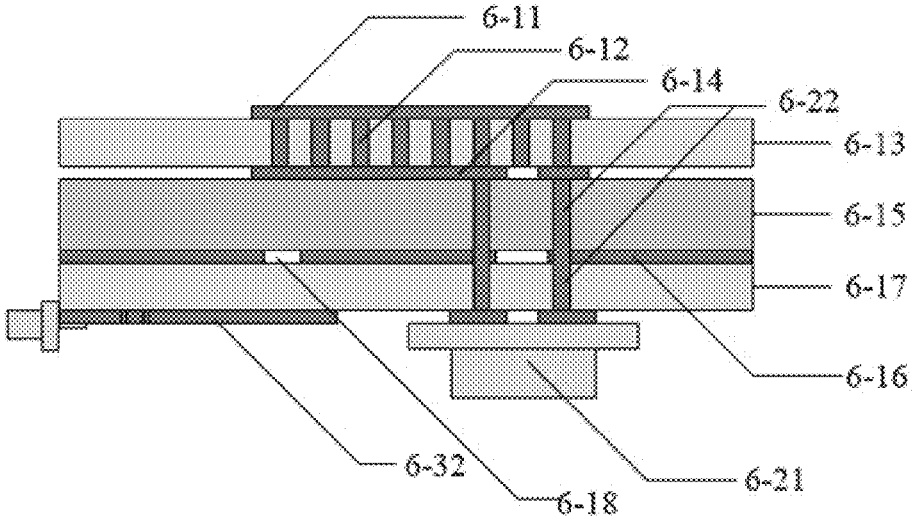
FIGS. 24A-24B show section views of the structure-reused shared-aperture antenna with large frequency ratio in Example 6.
Figure 24B:
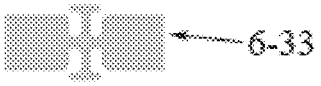

The waveguide feeding structure 6-2 is made up of the waveguide 6-21 and its waveguide to SIW transition structure. The waveguide to SIW transition structure comprises the metallized via 6-22, which runs through the second dielectric substrate layer 6-15 and the first dielectric substrate layer 6-17. The first copper metal layer 6-14 is connected to the metal ground 6-16 by this metallized via 6-22. As is shown in FIGS. 24A-24B, to ensure the realization of the metallized via 6-22, a ring of metal is disposed under the first dielectric substrate layer 6-17. As is shown in FIGS. 23A-23B, the rectangular windows are set in the first copper metal layer 6-14 and the metal ground 6-16 to ensure the energy can be feed in the SIW slot array antenna. The waveguide 6-21 is fixed under the first dielectric substrate layer by the flange plate.

Figure 25:
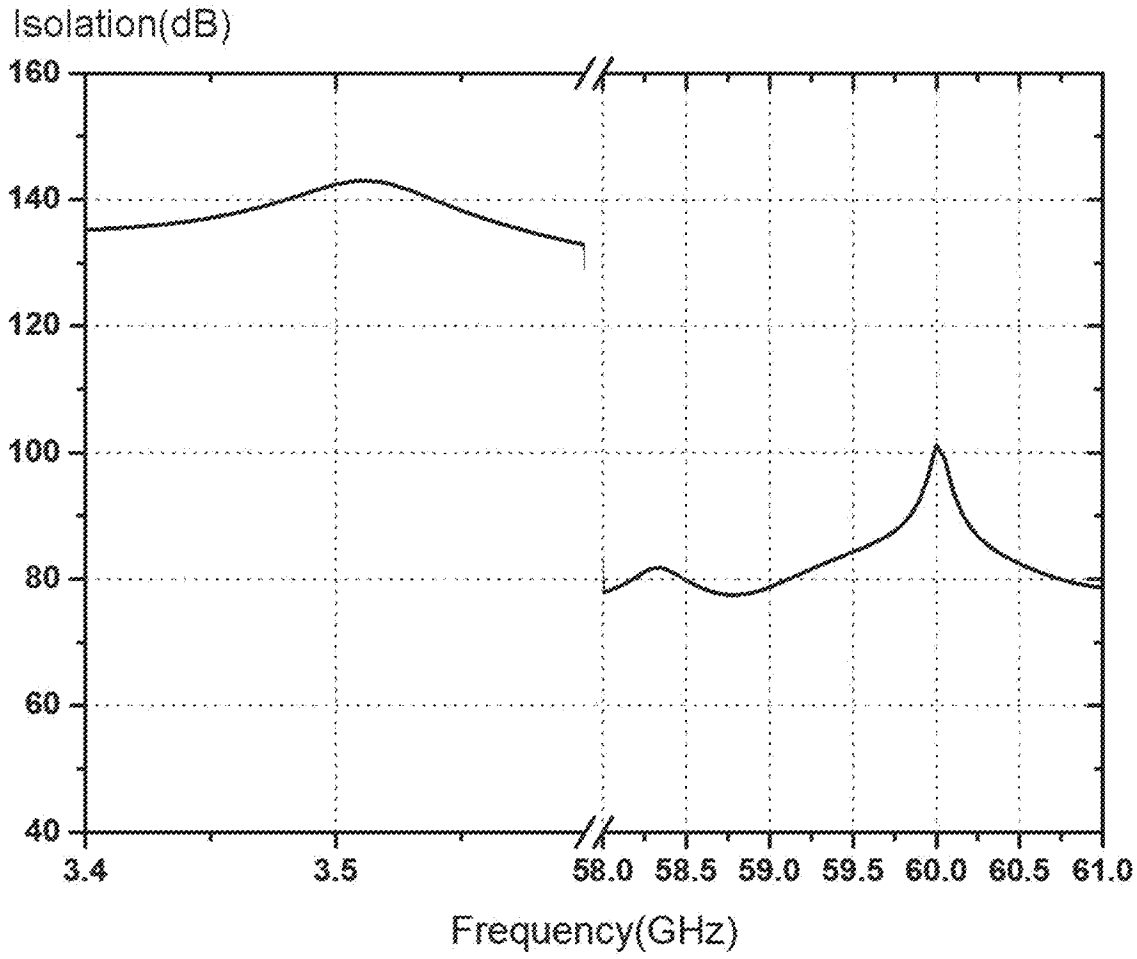
FIG. 25 shows simulated isolation results of the structure-reused shared-aperture antenna with large frequency ratio in Example 6.
Figure 26:
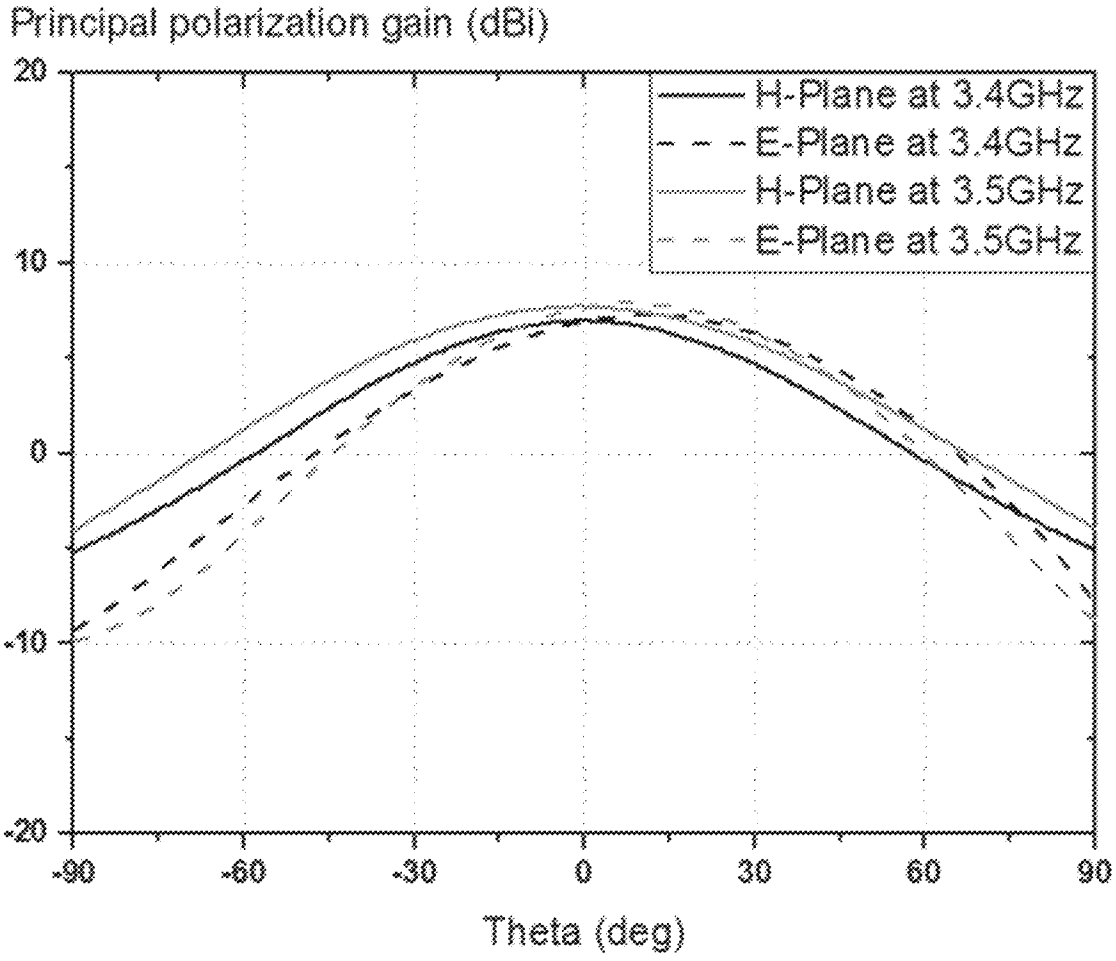
FIG. 26 shows simulated low-frequency power pattern of the structure-reused shared-aperture antenna with large frequency ratio in Example 6.
Figure 27:
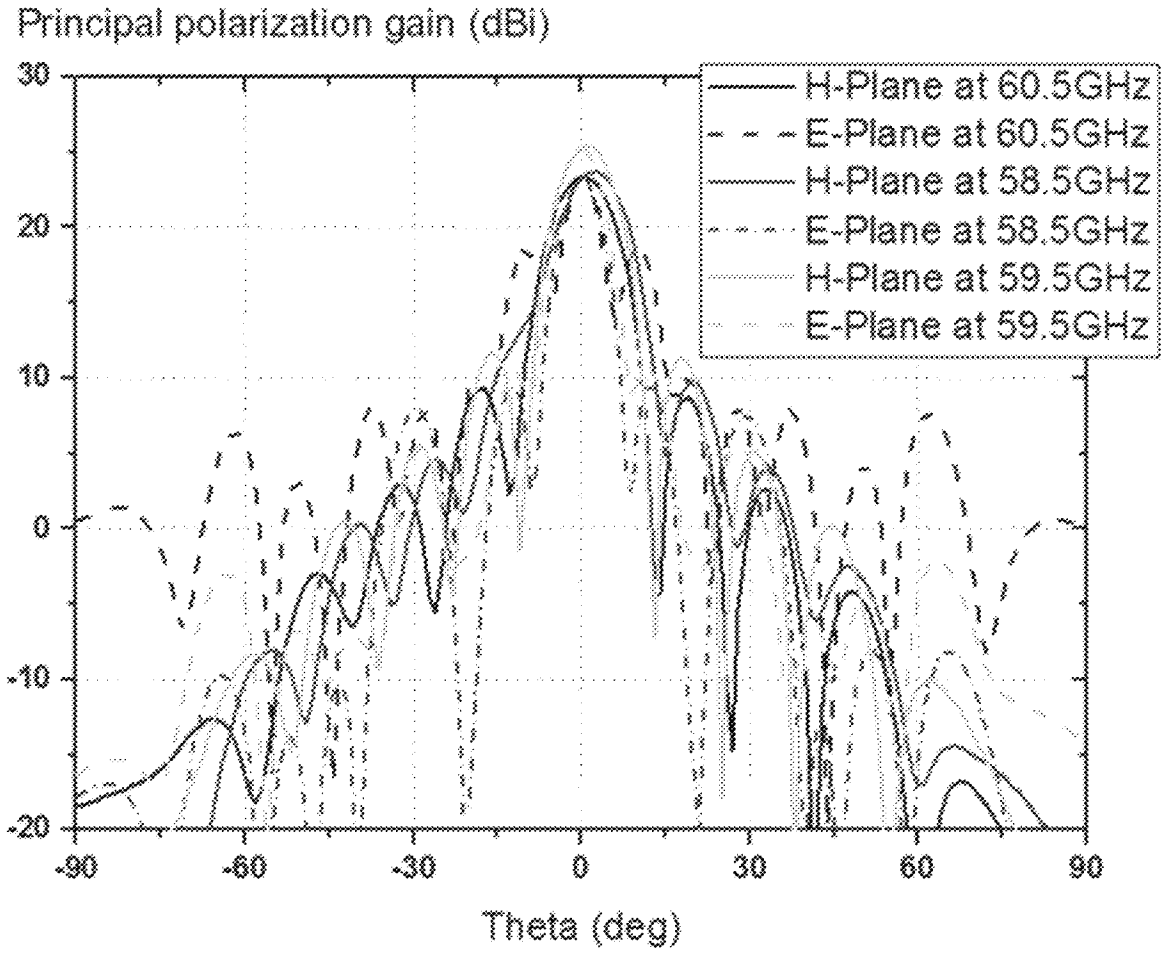
FIG. 27 shows simulated high-frequency power pattern of the structure-reused shared-aperture antenna with large frequency ratio in Example 6.

The large frequency ratio shared-aperture antenna with structure-reused technology is simulated, and the simulated isolation result is shown in FIG. 25. As is shown in this figure, this antenna can radiate in these two frequency bands, and the channel isolation between higher and lower frequencies are high.

The working principle of this embodiment is as follows: by using the low profile of the SIW and the metallized enclosed structure, it can be regarded as a patch element with a certain thickness. The radiating antenna comprises the first copper metal layer 6-14, the third dielectric substrate layer 6-13, the second copper metal layer 6-11 and the metallized via 6-12. It can be thought as the SIW slot array antenna and the patch antenna. The waveguide feeding structure is used to feed the higher frequency signal, and the microstrip feeding structure is used to feed the lower frequency signal. The radiating of large frequency ratio dual-band antenna can be realized. At the same time, a photonic band gap structure is used in the lower frequency microstrip feeding line 6-32. By using the cutoff characteristics of the high frequency versus low frequency of SIW and the band-resistance of photonic band gap structure to the high frequency signal, the high isolation between two bands can be achieved under the high aperture utilization ratio. In addition, the metallized via 6-22 in the waveguide to SIW transition structure can be used as the short-circuited via lower band patch antenna, and it can be used to adjust the operating frequency of the patch antenna slightly.

In conclusion, the beneficial effects of this embodiment are as follows: 1. based on the concept of the structure reuse, a dual-band share-aperture with large frequency ratio can be realized, the antenna occupies less space and has the achieve the highest structure reuse rate. 2. The feeding structures is separate. By using the cutoff characteristics of the waveguide and the band-resistance of photonic band gap structure to the high frequency, other frequency signal can be filtered in the transmission part. It can achieve the high isolation which existing large frequency ratio shared-aperture antenna cannot reach without extra filtering structures.

It will be obvious to those skilled in the art that changes and modifications may be made, and therefore, the aim in the appended claims is to cover all such changes and modifications.

What is claimed is:

1. A device, comprising:

1) a first copper metal layer;

2) a second copper metal layer; and 3) a dielectric substrate layer being sandwiched between the first copper metal layer and the second copper metal layer, the dielectric substrate layer comprising a plurality of metallized vias;

wherein:

the first copper metal layer is in communication with the second copper metal layer via the plurality of metallized vias which run through the dielectric substrate layer;

the plurality of metallized vias comprises first metallized vias forming an inner circular ring and second metallized vias forming an outer circular ring with respect to a center of the antenna;

the first copper metal layer, the dielectric substrate layer, the second copper metal layer, and the first metallized vias form a substrate integrated waveguide (SIW) circular cavity slot antenna;

the first copper metal layer, the dielectric substrate layer, the second copper metal layer, the first metallized vias and the second metallized vias form a coaxial cavity slot antenna; and the SIW circular cavity slot antenna and the coaxial cavity slot antenna comprises a plurality of radiating slots disposed in the second copper metal layer.

2. The device of claim 1, wherein an operating frequency ratio of the SIW circular cavity slot antenna and the coaxial cavity slot antenna is calculated as follows:

$$\frac{f_1}{f_2} = \frac{R_1}{R_2} = r$$

where $f_1$ is an operating frequency of the SIW circular cavity slot antenna, $f_2$ is an operating frequency of the SIW coaxial cavity slot antenna, $R_1$ is a radius of the outer circular ring, $R_2$ is a radius of the inner circular ring, and $r \leq 8$.

3. A device, comprising:

1) a first copper metal layer;

2) a second copper metal layer; and 3) a dielectric substrate layer being sandwiched between the first copper metal layer and the second copper metal layer;

wherein:

the dielectric substrate layer comprises four rectangular slots with the same size; the four rectangular slots are arranged successively in 90 degrees rotation with a center of the dielectric layer as a center;

the four rectangular slots run through the second copper metal layer, the dielectric substrate layer and the first copper metal layer;

the four rectangular slots each comprises a metallized inner wall functioning as a rectangular waveguide antenna;

the second copper metal layer comprises a center and a radiating slot is disposed in the center; and the first copper metal layer, the dielectric substrate layer, the second copper metal layer, and the radiating slot form a cavity slot antenna; the cavity slot antenna comprises four side walls, and four rectangular waveguide antennas are disposed on the four side walls, respectively.

4. A device, comprising:

1) a first copper metal layer;

2) a second copper metal layer; and 3) a dielectric substrate layer being sandwiched between the first copper metal layer and the second copper metal layer;

wherein:

the dielectric substrate layer comprises four circular slots with the same size located in four corners of the substrate layer, respectively;

the four circular slots run through the second copper metal layer, the dielectric substrate layer and the first copper metal layer;

each circular slot comprises a metallized inner wall functioning as a circular waveguide antenna;

a plurality of assistant metallized vias are disposed between two adjacent circular waveguide antennas;

the plurality of assistant metallized vias run through the first copper metal layer, the dielectric substrate layer and the second copper metal layer;

the second copper metal layer comprises a center and a radiating slot is disposed in the center; and the first copper metal layer, the dielectric substrate layer, the second copper metal layer and the radiating slot form a cavity slot antenna; the cavity slot antenna comprises four side walls, and the circular waveguide antenna and the plurality of assistant metallized vias are disposed on the four side walls.

5. A device, comprising:

1) a first copper metal layer;

2) a second copper metal layer; and 3) a dielectric substrate layer being sandwiched between the first copper metal layer and the second copper metal layer;

wherein:

the second copper metal layer comprises a rectangular monopole, a spiral line, and a plurality of rectangular stubs;

the rectangular monopole comprises a first side and a second side; the plurality of rectangular stubs is connected to the first side of the rectangular monopole; the plurality of rectangular stubs and the rectangular monopole form a comb structure;

the spiral line is connected to the second side of the rectangular monopole, and is disposed on one end of the rectangular monopole;

the rectangular monopole, the spiral line and the plurality of rectangular stubs form a printed inverted-F antenna (PIFA);

the dielectric substrate layer comprises a plurality of metallized vias, and the comb structure communicates with the first copper metal layer through the plurality of metallized vias to form a SIM leaky-wave antenna; and the SIW leaky-wave antenna comprises a radiating side disposed on the first side of the rectangular monopole connected to the plurality of rectangular stubs.

6. The device of claim 5, wherein the SIM leaky-wave antenna comprises a waveguide feeding structure; the waveguide feeding structure comprises a waveguide and a wavy guide to SIW transition structure; the waveguide to SIW transition structure comprises the plurality of metallized vias running through the dielectric substrate layer and a rectangular slot disposed in the first copper metal layer; and the waveguide is disposed under the first copper metal layer.

7. The device of claim 5, wherein the printed inverted-F antenna (PIFA) comprises a microstrip feeding structure disposed on the dielectric substrate layer; the microstrip feeding structure comprises a sub-miniature-A (SMA) connector and a microstrip line connected to the SMA connector; and the microstrip line is connected to the rectangular monopole to feed the antenna.

8. A device, comprising, successively in the following order:

1) a first copper metal layer;

2) a first dielectric substrate layer comprising a plurality of first metallized vias;

3) a feeding network layer;

4) a second dielectric substrate layer;

5) a middle copper metal layer;

6) a third dielectric substrate layer comprising a plurality of second metallized vias; and 7) a second copper metal aver;

wherein:

the second copper metal layer is electrically connected to the middle copper metal layer by the plurality of second metallized vias running through the third dielectric substrate layer;

the middle copper metal layer, the third dielectric substrate layer, the second copper metal layer and the plurality of second metallized vias form a plurality of SIW cavities which are arranged in a matrix;

in each SIW cavity, the second copper metal layer comprises a radiating slot, and the middle copper metal layer comprises a feeding slot, to form a SIW waveguide cavity slot antenna; and the feeding network layer feeds a signal to the SIW waveguide cavity slot antenna through the feeding slot;

the middle copper metal layer is electrically connected to the first copper metal layer by the plurality of first metallized vias running through the first dielectric substrate layer, the feeding network layer and the second dielectric substrate layer; the plurality of first metallized vias is disposed along one side of the first dielectric substrate layer;

the plurality of first metallized vias is electrically insulated from the feeding network layer; and the first cooper metal layer, the first dielectric layer, the feeding network layer, the second dielectric substrate layer, the middle copper metal layer, the third dielectric substrate layer and the second copper metal layer form a patch antenna; the patch antenna comprises one equivalent magnetic flux radiation edge which is parallel to an equivalent magnetic flux radiation edge and is short-circuited connected to a metal ground; and a short circuit point is under the first copper metal layer.

9. The device of claim 8, wherein assume fL0 is a center frequency of the SIW waveguide cavity slot antenna, and fH0 is a center frequency of the patch antenna, and $fL0/fH0 \geq 2$.

10. A device, comprising:

a radiating structure;

a waveguide feeding structure; and a microstrip feeding structure;

wherein:

the radiating structure comprises a first dielectric substrate layer, a metal ground, a second dielectric substrate layer, a first copper metal layer, a third dielectric substrate layer, and a second copper metal layer, successively;

the second copper metal layer comprises a SIW slot array;

the third dielectric substrate layer comprises a plurality of first metallized vias, and the second copper metal layer communicates with the first copper metal layer by the plurality of metallized via running through the third dielectric substrate layer to form a radiating antenna;

the microstrip feeding structure is disposed under the first dielectric substrate layer; the radiating antenna is excited by a coupled slot disposed in the metal ground; and the waveguide feeding structure comprises a waveguide and a waveguide to SIW transition structure; the waveguide to SIW transition structure comprises a plurality of second metallized vias running through the second dielectric substrate layer and the first dielectric substrate layer; the first copper metal layer is connected to the metal ground by the second metallized vias; the first copper metal layer and the metal ground comprise windows; and the waveguide is disposed under the first dielectric substrate layer.

* * * * *